US006984158B2

(12) United States Patent
Satoh et al.

(10) Patent No.: US 6,984,158 B2
(45) Date of Patent: Jan. 10, 2006

(54) COOLING WATER PUMP DEVICE FOR OUTBOARD MOTOR

(75) Inventors: Takuya Satoh, Hamamatsu (JP); Koji Naganuma, Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 10/781,802

(22) Filed: Feb. 20, 2004

(65) Prior Publication Data

US 2004/0165985 A1 Aug. 26, 2004

(30) Foreign Application Priority Data

Feb. 25, 2003 (JP) ..... 2003-047813
Jan. 15, 2004 (JP) ..... 2004-008225

(51) Int. Cl.
*B63H 21/38* (2006.01)

(52) U.S. Cl. ..... 440/88 P

(58) Field of Classification Search ..... 440/88 P, 440/FOR. 88

See application file for complete search history.

(56) References Cited

U.S. PATENT DOCUMENTS 4,392,779 A * 7/1983 Bloemers et al. ..... 415/141
4,411,593 A * 10/1983 Taguchi ..... 415/232

FOREIGN PATENT DOCUMENTS

| | | | |
|---|---|---|---|
| JP | 2-126992 | U | 10/1990 |
| JP | 4-321891 | * | 11/1992 |
| JP | 5-133349 | A | 5/1993 |
| JP | 5-47458 | U | 6/1993 |
| JP | 5-58883 | U | 8/1993 |
| JP | 5-58884 | U | 8/1993 |
| JP | 5-306687 | A | 11/1993 |
| JP | 9-317661 | A | 12/1997 |

OTHER PUBLICATIONS

Translation of Japan 4-321891.*

* cited by examiner

*Primary Examiner*—Sherman Basinger
(74) *Attorney, Agent, or Firm*—Nixon & Vanderhye, P.C.

(57) ABSTRACT

A cooling water pump device for drawing cooling water from bottom of a pump case and pumping it toward an engine located above includes: a multiple number of annular seal elements surrounding the driveshaft for keeping the interface between the inner peripheral surface of a resin pump case and a metal sleeve watertight, arranged between the inner peripheral surface of the resin pump case and the metal sleeve, at plural positions vertically apart with respect to the axial direction of the driveshaft.

8 Claims, 16 Drawing Sheets

O-ring configurations

Conventional stainless cooling pump configuration

Conventional resin cooling pump configuration

COOLING WATER PUMP DEVICE FOR OUTBOARD MOTOR

BACKGROUND OF THE INVENTION (1) Field of the Invention

The present invention relates to a cooling water pump device for pumping cooling water toward an engine of an outboard motor that includes a hollow driveshaft housing under the engine and a driving shaft vertically mounted in the driveshaft housing for transmitting the drive force of the crankshaft of the engine to a screw.

(2) Description of the Prior Art

The outboard motor engine is cooled by taking in seawater or river water through, for example, a water filter in the lower case (or gear case) and forwarding the intake seawater or river water to the water jacket of the engine as cooling water.

In general, an outboard motor is equipped with a cooling water pump device for sending (pumping up) cooling water for engine cooling.

Specifically, an outboard motor is provided under its engine with a driveshaft housing that incorporates a driving shaft mounted vertically for transmitting the drive force of the crankshaft of the engine to a screw. The outboard motor has a cooling water pump device (water pump) which by using an impeller made of elastic material, accommodated eccentrically in the pump case, at a position partway through the length of the driveshaft, pushes cooling water forwards to the engine by rotation of the impeller inside the pump case as the driveshaft is driven (see Japanese Patent Application Laid-open Hei 5 No. 306687 and Japanese Utility Model Application Laid-open Hei 2 No. 126992).

As stated above, the cooling water pump device of an outboard motor employs a so-called water cooling type which draws cooling water and pushes it forward to the engine side so as to cool the engine with the thus pumped cooling water. In general, almost all models of outboard motors, from compact models (low horsepower models) as low as 2 horsepower (2 hp) to large-scale models (high horsepower models) as high as 250 horsepower employ water cooled engines that use a cooling water pump device.

The material of the pump case used for cooling water pump devices can be classified roughly into stainless steel and resin. As specific configurations, FIG. 15 shows a cooling water pump device with a pump case "b" formed of stainless steel and FIG. 16 shows a cooling water pump device with a pump case "b" of resin.

Either of these cooling water pump devices shown in FIGS. 15 and 16 is assembled around a driveshaft "a" of the outboard motor, and an impeller "c" of elastic material is arranged eccentrically inside the pump case "b" and is fixed to driveshaft "a" by a key "d" with respect to the direction of rotation.

As the impeller "c" is rotationally driven as driveshaft "a" turns, water for cooling is drawn in from the outside of the outboard motor through an inlet port (not shown) of a lower case "e" (also called a gear case: accommodating gears and a screw shaft) located at the bottom of driveshaft "a" and pumped toward the engine. Concerning each pump case "b", in order to secure watertightness at the contact face with lower case "e", the pump case "b" is mounted by interposing an under-panel "f" and a gasket "g" between the underside of pump case "b" and the top side of lower case "e".

In the case of a cooling water pump device of the type shown in FIG. 15, using a stainless pump case "b", it can present a high enough strength against sliding of impeller "c". On the other hand, in the case of a cooling water pump device of the type shown in FIG. 16, using a resin pump case "b", a sleeve "h" made of metal such as stainless steel, is fitted to the pump case "b" side which impeller "c" comes into sliding contact with so as to prevent abrasion of pump case "b" due to rotation of impeller "c". Further, an O-ring "i" is held between the abutment faces of resin pump case "b" and under-panel "f" and fixed by bolts.

In contrast with this, in the stainless pump case of the type shown in FIG. 15, the fitting surface of the pump case to the under-panel "f" is flattened so that no O-ring is used at the interface.

The advantage of using a stainless pump case for the cooling water pump device of an outboard motor is that when the engine is started in the dry for maintenance of the outboard motor, no deficiency such as the onset of case fusing will occur if the impeller "c" rotates and generates heat at its sliding surface with the pump case due to lack of cooling water. Therefore, it is possible to use the outboard motor in an ordinary manner after checkup with the engine started. Further, as will be described later, no metal sleeve is used as used for resin pump cases, hence there is no possibility of salt building up between the pump case and the metal sleeve and producing cracks that might cause the sleeve to move toward the case.

Because of these advantages, conventional pump cases, in general, have been made of stainless steel.

However, a pump case made of stainless steel suffers from various drawbacks: it is heavier than the that made of resin, causing a hindrance to lightening of the engine; and it is usually produced using the lost wax process, which is poor in mass productivity and needs high material cost and processing cost, resulting increase in cost.

For the above reasons, recently there has been a trend toward using resin pump cases. There are various advantages of using a resin pump case: it can be configured of a reduced number of parts because its parts can be integrally formed within limits and hence it is preferable for mass production; the weight of the pump case is lighter than that made of stainless steel or other metal, so that the pump, hence the outboard motor can be readily lightened; and the cost is low because the materials are inexpensive and the processing cost is low.

However, the resin pump case tends to deform due to heat during the operation in the dry. Further, for the case where outboard motors are used in seawater, saltwater may enter the interface between the pump case and the metal sleeve, forming salt buildup which may cause cracks in the case and deformation of the metal sleeve.

As a measure to prevent infiltration of salt water into the interface between the pump case and metal sleeve, a sealant for water protection may be applied between the metal sleeve and the pump case.

However, the applied amount of sealant may vary depending on the worker. Use of an automatic sealant coater to deal with this results in cost increase. And also, the sealant effectiveness will become lower due to heat and aging. Further, when the metal sleeve is to be replaced, adhesion of sealant is hard to peel off, increasing the workload. Moreover, when a new part is to be assembled, sealant is to be applied at a site in the local dealer, resulting in increase the number of steps and yet lack of reliability.

SUMMARY OF THE INVENTION

The present invention has been devised to solve the above problems it is therefore an object of the present invention to provide a cooling water pump device for an outboard motor, which, even with the use of a pump case made of resin and a metal sleeve fitted therein, can reliably prevent infiltration of water such as seawater into the interface between the pump case and the sleeve without the need of sealant application, prevent the pump case from cracking due to salt buildup, can reduce the work load and cost by omitting the step of sealant application, and can positively prevent deformation due to heat during the operation in the dry.

In order to achieve the above object, the present invention is configured as follows:

In accordance with to the first aspect, the cooling water pump device for an outboard motor, for pumping cooling water toward an engine of an outboard motor that includes a hollow driveshaft housing under an engine and a driving shaft vertically mounted in the driveshaft housing for transmitting the drive force of the crankshaft of the engine to a screw, comprising: a pump case made of resin disposed at a position partway, with respect to the axial direction of the driveshaft, inside the driveshaft housing; a sleeve made of metal fitted in the pump case; an impeller made of elastic material mounted eccentrically in the pump case with the metal sleeve interposed therebetween, the impeller being rotated by rotational drive of the driveshaft to draw cooling water from the bottom of the pump case and pump the cooling water toward the engine located above; and a plurality of annular seal elements for keeping the interface between the inner peripheral surface of the resin pump case and the metal sleeve watertight, arranged between the inner peripheral surface of the resin pump case and the metal sleeve, surrounding the driveshaft, and disposed at plural positions vertically apart with respect to the axial direction of the driveshaft.

The cooling water pump device for an outboard motor defined in the second aspect is characterized in that the pump case having the above first feature has an approximately bowl-like configuration having a bottom opening which is covered with an under-panel forming a pump chamber that accommodates the impeller, and at least the annular seal elements are arranged at an upper end of an ejection port of the pump chamber and at a place surrounding the driveshaft insert hole at an upper position of the pump case.

The cooling water pump device for an outboard motor defined in the third aspect is characterized in that, in the invention of the first aspect, a plurality of joint seal elements that extend in the axial direction or radial direction of the driveshaft and connect the annular seal elements one to another, are provided so as to produce a unified structure of the annular seal elements made up of elastic resin material to keep the interface between the inner peripheral surface of the resin pump case and the metal sleeve watertight.

The cooling water pump device for an outboard motor defined in the fourth aspect is characterized in that, in the invention of the third aspect, the lower annular seal element disposed between the bottom opening rim of the pump case and the under-panel and the upper annular seal element disposed at a place surrounding the driveshaft insert hole at an upper position of the pump case are connected by the joint seal elements, and at least the joint seal elements are arranged at both sides of the ejection port of the pump chamber.

The cooling water pump device for an outboard motor defined in the fifth aspect is characterized in that, in the invention of the first aspect, grooves for receiving seal elements are formed in the inner peripheral surface of the pump case.

The cooling water pump device for an outboard motor defined in the sixth aspect is characterized in that, in the invention of the first aspect, ribs are formed in the interior surface of the pump case so as to create an air layer between the pump interior surface and the metal sleeve.

According to the inventions of the first to sixth aspects, in the cooling water pump device of an outboard motor, a plurality of annular seal elements that surround the driveshaft for creating watertightness at the interface between the inner peripheral surface of the resin pump case and the metal sleeve are disposed vertically apart, one from another, with respect to the axial direction of drive shaft, between the inner peripheral surface of the resin pump case and the metal sleeve. Therefore it is possible to reliably prevent water such as seawater from infiltrating into the interface between the pump case and the sleeve by virtue of the water-protective function of the annular seal elements even when the outboard motor is used in the sea.

Accordingly, it is possible to positively prevent the salt buildup problem which would occur when water, especially seawater infiltrates into and between the resin pump case and the metal sleeve as in the conventional cooling water pump device and the possible initiation of cracks in the metal sleeve due to salt buildup.

The invention having each of the above features presents the following effect in addition to the above effect.

In the invention according to the above second feature, the pump case has an approximate bowl-shape having a bottom opening which is enclosed by an under-panel, forming a pump chamber that accommodates an impeller therein. At least the aforementioned annular seal elements are disposed at the upper end of the ejection port of the pump chamber and at a place surrounding the driveshaft insert hole at the upper position of the pump case, so that the pump case can be constructed so as to have a bottom opening which permits easy assembly of the sleeve and impeller. Also, provision of the annular seal elements at the upper end of the ejection port of the pump chamber and at a place surrounding the driveshaft insert hole at the upper position of the pump case produces sufficient watertight performance. Further, since the portion that would cause drawback in a conventional pump case when a trial operation is carried out in the dry without cooling water is positioned in the top side area of the pump case and the place surrounding the driveshaft insert hole at the upper position of the pump case and the ejection port of the pump chamber are sealed with the annular seal elements, it is possible to secure watertightness and solve the inconvenience of operation in the dry. As to the matter with salt buildup between the pump case and the sleeve, water is unlikely to stagnate across the upright side wall portion of the sleeve extending along the driveshaft, the provision of a seal at the ejection port and the place surrounding the driveshaft insert hole only also establishes effective watertightness.

According to the invention of the above third feature, a plurality of joint seal elements that extend in the axial direction or radial direction of the driveshaft to connect the annular seal elements to each other are provided so as to produce a unified structure of the annular seal elements made up of elastic resin material to create watertightness between the inner peripheral surface of the resin pump case and the metal sleeve. Therefore, watertightness against infiltration of water such as seawater into the interface between the pump case and the sleeve can be achieved in a more reliable manner by the integrated water protecting function of the joined elements. Moreover, handling at manufacturing and assembly is simple compared to that when the seal elements are provided piece by piece. Moreover, the seal can be formed of resin material of a uniform composition and the strength at the joints can be enhanced in terms of design.

According to the invention of the above fourth feature, the joint seal elements are used to connect the lower annular seal element interposed between the bottom opening rim of the pump case and the under-panel, with the upper annular seal element arranged at a place surrounding the driveshaft insert hole at the upper position of the pump case and the joint seal elements are disposed at least at both sides of the ejection port of the pump chamber. Therefore, infiltration of water such as seawater into the interface between the pump case and the sleeve through the surrounding of the ejection port of the pump chamber can be more reliably prevented by these joint seal elements.

According to the invention of the above fifth feature, since grooves for receiving seal elements are formed in the inner peripheral surface of the pump case, only the fitting of the sealing elements into these grooves makes it possible to attach the seal elements simply and reliably when the sealing structure is fitted into the pump case.

According to the invention of the above sixth feature, since ribs are formed in the interior surface of the pump case so as to create an air layer between the pump interior surface and the metal sleeve, frictional heat arising when the impeller frictionally rotates inside the sleeve can be prevented from transferring to the pump case by insulation and reduction of heat conduction owing to presence of the air layer. As a result it possible to reliably prevent the resin pump case from being heated by the frictional heat and hence prevent the resin pump case from melting.

DESCRIPTION OF THE PREFERRED EMBODIMENTS

The embodiments of the present invention will hereinafter be described in detail with reference to the accompanying drawings.

Figure 1:
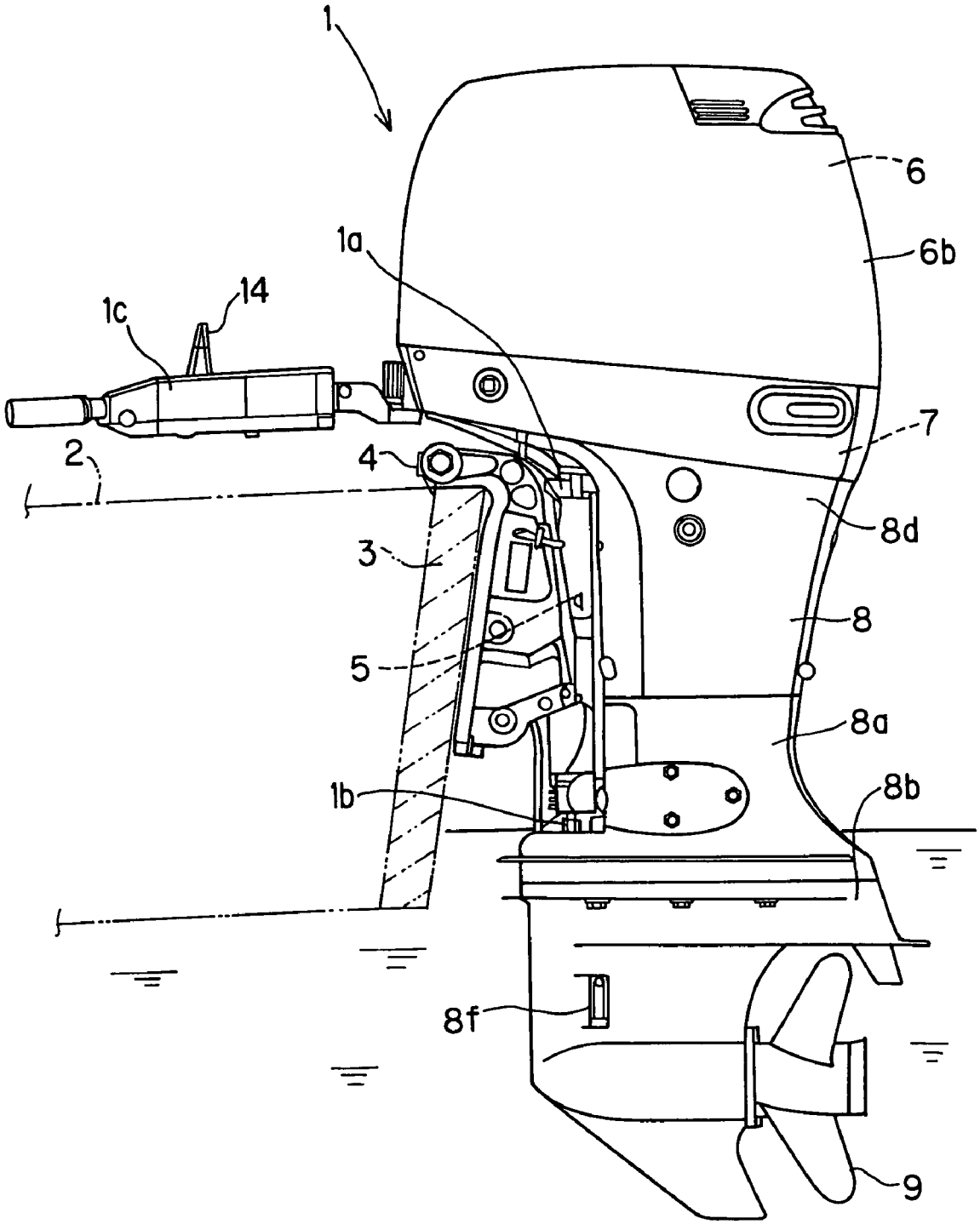
FIG. 1 is an external side illustration showing an outboard motor according to one embodiment of the present invention.
Figure 2:
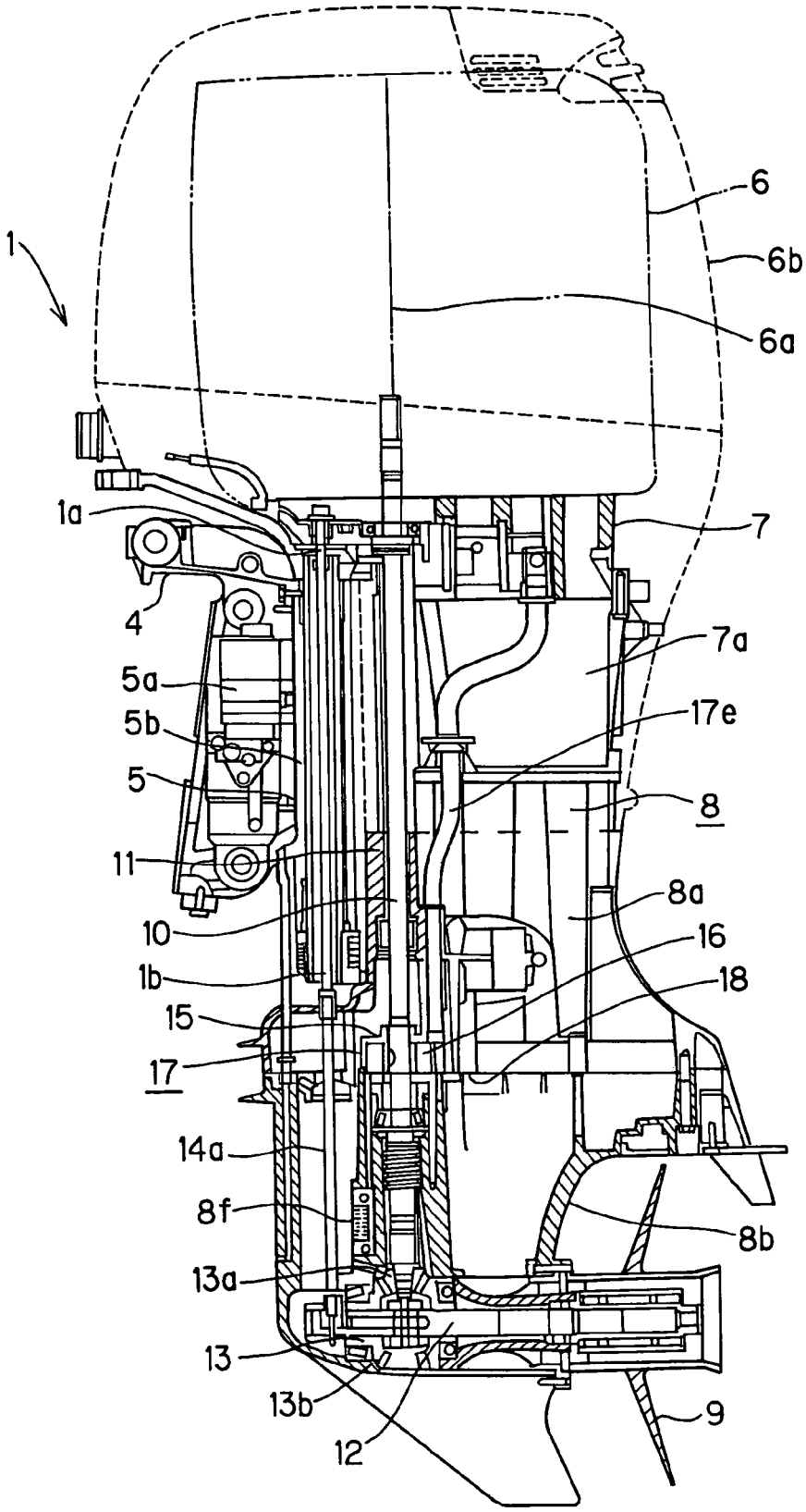
FIG. 2 is a vertical sectional illustration showing a drive mechanism under an engine of the outboard motor shown in FIG. 1 and the arrangement of a cooling water pump device and others.

As shown in FIGS. 1 and 2, the outboard motor 1 is fixed and mounted on the top of a transom 3 at the rear part of a boat 2 by means of a clamp bracket 4 that grips the top of the transom 3. The clamp bracket 4 pivotally supports a swivel bracket 5 that can sway up and down.

This swivel bracket 5 is axially supported at its upper and lower ends (of a cylinder portion 5*b* on the driveshaft housing 8 side) by the top 1*a* and bottom 1*b* on the front side of driveshaft housing 8 of outboard motor 1. With this arrangement, outboard motor 1 can swivel left and right within a certain range of angle with respect to clamp bracket 4 by control of a handle 1*c*.

Swivel bracket 5 is adapted to be driven by an actuator 5*a* of a hydraulic type (Power Tilt and Trim, abbreviated as 'PTT') or the like so that it sways up and down with respect to clamp bracket 4 (see FIG. 2).

In outboard motor 1, as shown in FIGS. 1 and 2, driveshaft housing 8, which is an hollow body extending vertically and has a horizontal section of a spindle shape, is joined to the swivel bracket 5 while an engine holder 7 on which an engine 6 (roughly depicted by its outline in FIG. 2) is mounted and fixed with bolts is provided on top of driveshaft housing 8.

Arranged vertically inside the driveshaft housing 8 is a driveshaft 10 which transmits the driving force from crankshaft 6*a* (the central axis is shown in FIG. 2) of the engine to a screw 9. Further, driveshaft housing 8 is constituted of engine holder 7 and vertically separable upper and lower cases 8*a* and 8*b* which are joined to the underside of engine holder 7.

The engine 6 located on top of the outboard motor and fixed to engine holder 7 with bolts is enclosed by a helmet-like upper cover 6*b*. Further, a lower cover 8*d* is provided so as to cover the range from engine holder 7 of driveshaft t housing 8 to the upper edge of upper case 8*a* so as to produce a unified appearance of the outboard motor.

A box-like oil pan 7*a* for receiving and temporarily storing lubricant flowed from engine 6 is provided under the engine holder 7.

In the driveshaft t housing 8, driveshaft 10 is rotatably accommodated inside a hollow 11 that extends vertically across engine holder 7, upper case 8*a* and lower case 8*b*.

The upper end of the driveshaft 10 projects out above the engine holder 7 and is inserted into and coupled with the lower end of crankshaft 6*a* of engine 6. A drive gear 13*a* of a bevel gear set 13 inside lower case 8*b* is fixed at the lower end of the driveshaft 10 with respect to the direction of rotation.

Housed in lower case 8*b* are a screw shaft 12 which rotates on a rotational axis that is perpendicular to the rotational axis of driveshaft 10 and bevel gear set 13 which transmits the driving force from driveshaft 10 to screw shaft 12 (screw 9).

The rotational rate of the engine is varied (preferably reduced) by the setting of the gear ratio of the bevel gear set 13 (preferably, the number of teeth of the drive gear<the number of teeth of the driven gear) and transmitted to screw shaft 12.

A pair of driven gears 13*b*, in bevel gear set 13, are provided so as to mesh drive gear 13*a* from the front and rear. In this arrangement, the control movement of an aftermentioned shift lever 14 is transmitted via a shift rod 14*a* to a clutch mechanism arranged between screw shaft 12 and paired driven gears 13*b*, whereby one of the driven gears 13*b* is selectively engaged with or disengaged from screw shaft 12 (by shift control), so that the action of screw shaft 12 can be switched between normal rotation, reverse rotation and neutral.

Specifically, for example, shift lever 14 is provided for steering handle 1*c* so that the user (operator) is able to make shift operations during maneuvering while grasping the handle 1*c*. The aforementioned shift rod 14*a* is arranged from its top to bottom passing through cylinder portion 5*b* of swivel bracket 5 that is axially supported by the top 1*a* and bottom 1*b* on the front side of driveshaft housing 8 located in front of the driveshaft 10, and the lower end is positioned at the front end of screw shaft 12, whereby the clutch mechanism between driven gears 13*b* of the bevel gear set 13 and screw shaft 12 can be selectively engaged or disengaged.

Figure 3:
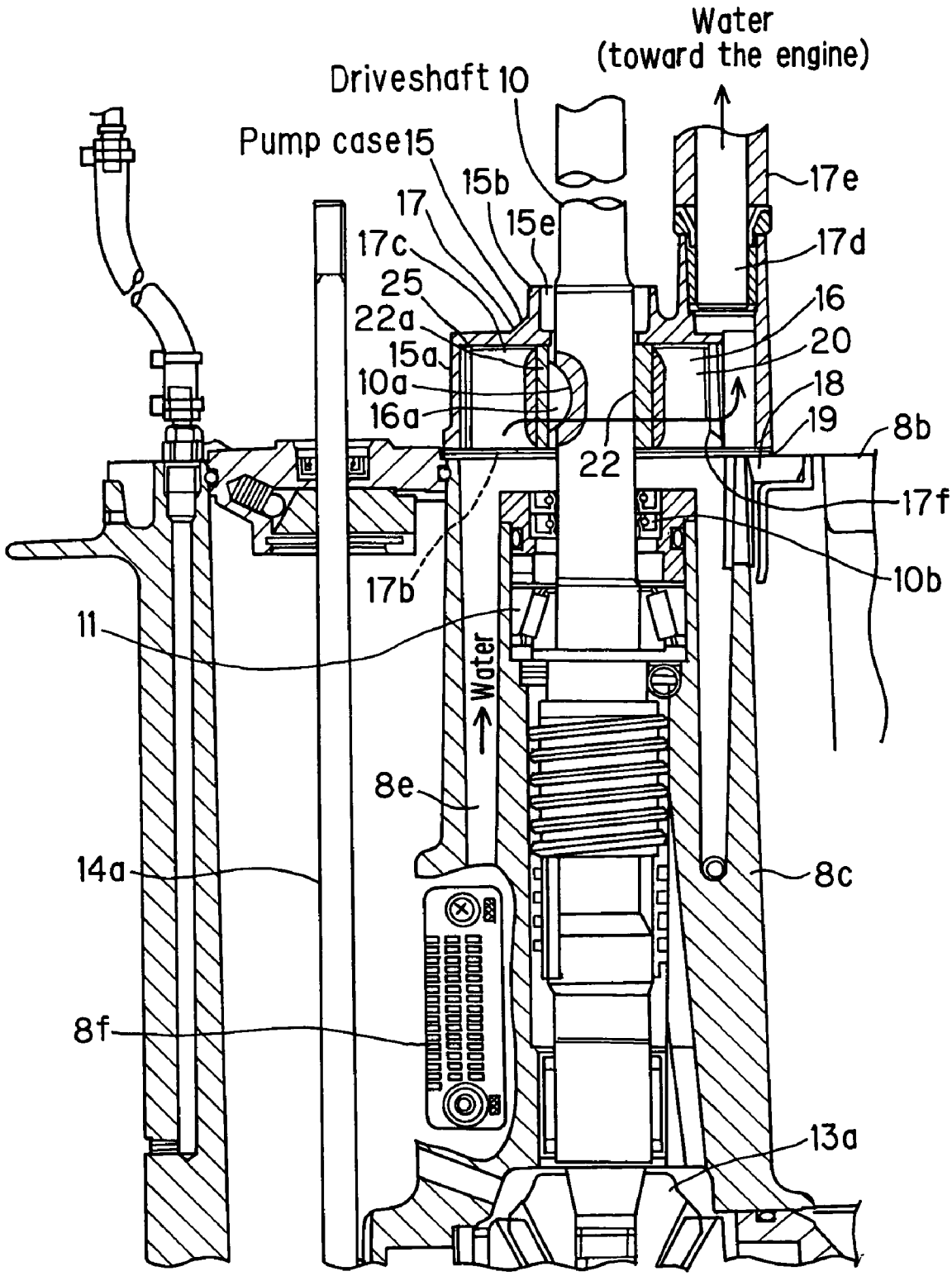
FIG. 3 is a detailed vertical sectional illustration showing a cooling water pump device of an outboard motor and its lower portion according to one embodiment.

In the present embodiment, as shown in FIG. 3, a cooling water pump device 17 that uses the driveshaft 10 as a driveshaft therefor is arranged at a position partway through the length of the driveshaft 10 in the driveshaft housing 8.

In this cooling water pump device 17, an impeller 16 of elastic material such as rubber, is arranged eccentrically inside the pump case 15 made of resin such as Nylons® resin, with a sleeve 25 made of metal such as stainless steel disposed therebetween. As the driveshaft 10 is driven, the impeller 16 rotates, whereby cooling water is drawn in from an aftermentioned inlet 17*b* to push the cooling water out to the engine 6 located above.

In the aforementioned hollow 11 of lower case 8*b* of the driveshaft housing 8, a wall portion 8*c* that surrounds driveshaft 10 and has a watertight seal 10*b* for sealing between the lower part of driveshaft 10 and the intake side of cooling water pump device 17, inserted at the upper end thereof, is formed upright. Inside this wall portion 8*c* a cooling water conduit 8*e* is extended upwards to the bottom of cooling water pump device 17. Because of this cooling water conduit 8*e* the upper portion of wall portion 8*c* presents a double cylindrical configuration of outer and inner walls, and this inner cylindrical wall serves as the cylinder that surrounds driveshaft 10.

An inlet port 8*f* for taking water (seawater, river water) from the outside of the outboard motor is opened with a filter on the side portion of the lower case 8*b*, and the interior of inlet port 8*f* is connected to the cooling water passage 8*e*.

Figure 4:
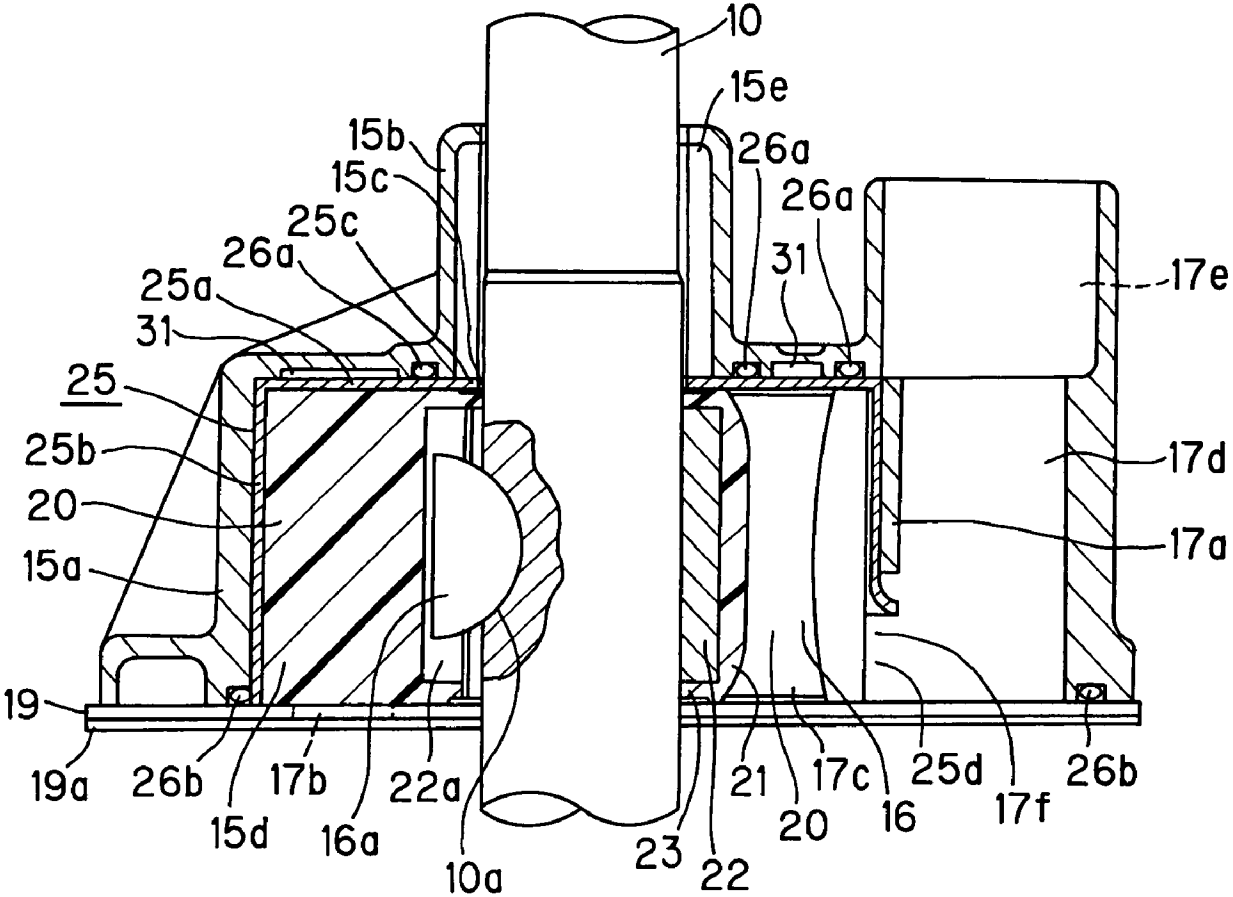
FIG. 4 is a vertical sectional view for illustrating the configuration of a cooling water pump device.

In the cooling water pump device 17, as shown in FIGS. 3 and 4, pump case 15 is formed of a large-diametric approximate cylinder (large-diametric cylinder) 15*a* and a small-diametric approximate cylinder (small-diametric cylinder) 15*b*, arranged below and above, respectively, and joined to each other continuously. The wall separating large-diametric cylinder 15*a* and small-diametric cylinder 15*b* is formed with an opening, i.e. , insert hole 15*c* through which driveshaft 10 penetrates. Further, a plate-like under-panel 19 (having an inlet 17*b* opened as a cooling water inlet port, as indicated by the broken line in FIG. 4) is provided to cover the bottom opening, designated at 15*d*, of the large-diametric cylinder 15*a* that opens downward, thus forming a pump chamber 17*c* inside pump case 15. This under-panel 19 has a gasket 19*a* on its undersurface so as to establish watertightness with the contact portion of lower case 8*b*.

In the pump device 17, as shown in FIGS. 3 and 4, impeller 16 is constructed of plural, radially extended vanes 20 and an approximately cylindrical boss portion 21, these elements being integrally formed of an elastic material such as rubber. Further, a tubular core 22 made of a material that has a higher rigidity than the elastic material (e.g. , hard resin or metal) is embedded to this boss portion 21. This tubular core 22 is fixed to the inner periphery of boss portion 21 with its end faces, with respect to the axial direction, covered with inner flanges 23 formed in boss portion 21.

Formed in the inner peripheral surface of tubular core 22 is a key slot 22*a* extending axially. A key 16*a* having a semicircular form, viewed from side, is inserted into both the key slot 22*a* and another key slot 10*a* formed in driveshaft 10, whereby impeller 16 is integrally fixed to driveshaft 10 with respect to the direction of rotation. Upon-assembly of cooling water pump device 17, key 16*a* is adapted to be fitted into key slot 22*a* of tubular core 22 of impeller 16 after key 16*a* is fitted to key slot 10*a* of driveshaft 10.

The cooling water pump device 17 is mounted in drive-shaft housing 8 in such a manner that the under-panel 19 is positioned in correspondence with the joint portion, designated at 18, of the upper case 8*a* to lower case 8*b* and the approximate cylindrical cap-like pump case 15 is projected upward into the upper case 8*a* side. Other than small-diametric cylinder 15*b*, an outlet 17*d* that opens upward as a cooling water outlet port is formed at a side upper part of pump case 15. The lower end of a cooling water pipe 17*e* extending upward is connected to this outlet 17*d*. The upper end of this cooling water pipe 17*e* is connected to the water jacket (not shown) of engine 6.

As the aforementioned inlet port 8*f*, cooling water conduit 8*e*, inlet 17*b*, pump case 15 (pump chamber 17*c*), outlet 17*d*, cooling water pipe 17*e* and the like constitute a cooling water path, a negative pressure arises as shown in FIG. 3 to FIGS. 5A and 5B when cooling water pump device 17 is actuated. By this negative pressure, water is taken in from the outside of outboard motor 1 from the inlet port 8*f*, passing through cooling water conduit 8*e* and inlet 17*b* opened in under-panel 19 under cooling water pump device 17 into pump chamber 17*c*.

Then, cooling water is positively pressurized in pump chamber 17*c* of the cooling water pump device 17, is supplied to the water jacket of engine 6 through outlet 17*d* and cooling water pipe 17*e*, to cool down the engine 6.

Designated at 17*a* is a guide wall portion for leading cooling water from pump chamber 17*c* to outlet 17*d*. This guide wall portion 17*a* constitutes part of the wall that surrounds the pump chamber 17*c* and is located on the positive pressure side forming an ejection port 17*f*. This ejection port 17*f* establishes communication between pump chamber 17*c* and outlet 17*d* and is provided in the form of a cutout window located at the lower part of the guide wall portion 17*a*.

The cooling water pump device 17 here is formed of resin pump case 15, which is low in manufacturing costs such as material cost and processing cost, and metal sleeve 25 inside the pump case 15, so as to prevent melting and deformation due to frictional heat arising when impeller 16 frictionally rotates. As shown in FIG. 4 to FIGS. 6A and 6B, in cooling water pump device 17, annular seal elements 26 (upper annular seal element 26*a* and lower annular seal element 26*b*) are arranged vertically apart and interposed between pump case 15 and metal sleeve 25 in order to secure and improve watertightness therebetween. These elements are joined by joint seal elements 27, thus forming a one-piece continuously formed, sealing structure 28.

More specifically, as shown in the vertical sectional view of cooling water pump device 17 in FIG. 4, the seal structure 28 is formed of a multiple number of (two, above and below in this embodiment) annular seal elements 26 (26*a*, 26*b*) which encircle the driveshaft 10 and are arranged apart vertically with respect to the axial direction of driveshaft 10 so as to be interposed between the inner peripheral surface of the resin pump case 15 and metal sleeve 25, and a multiple number of joint seal elements 27 which extend in the axial direction to join each annular seal element 26 (26*a*, 26*b*) to the other, so that the annular seal elements 26 (26*a*, 26*b*) retain watertightness between the inner peripheral surface of pump case 15 and metal sleeve 25.

Figure 5B:
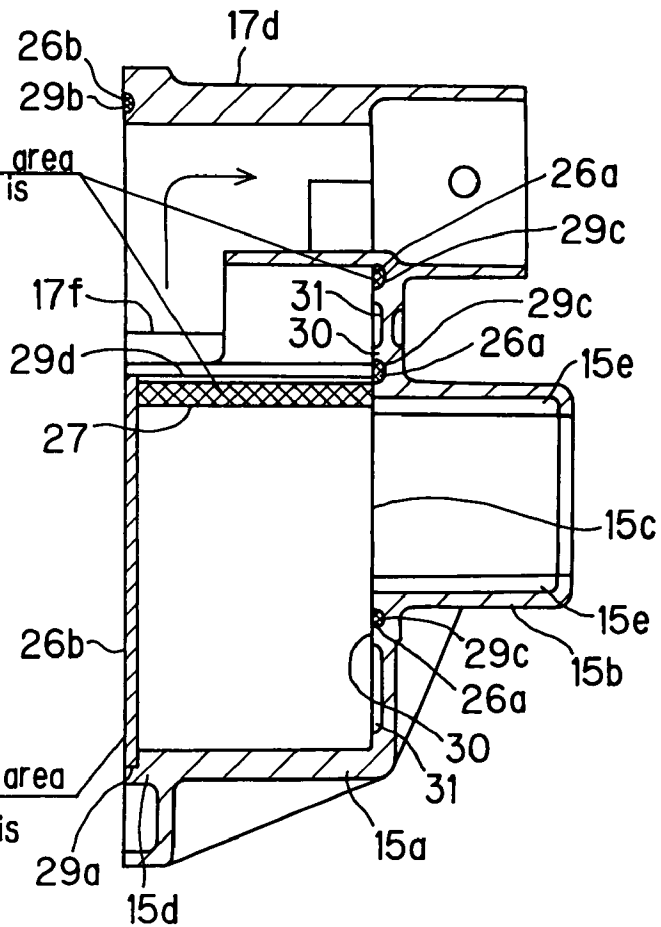
FIG. 5B is a vertical sectional view cut along a line B—B in FIG. 5A.
Figure 5A:
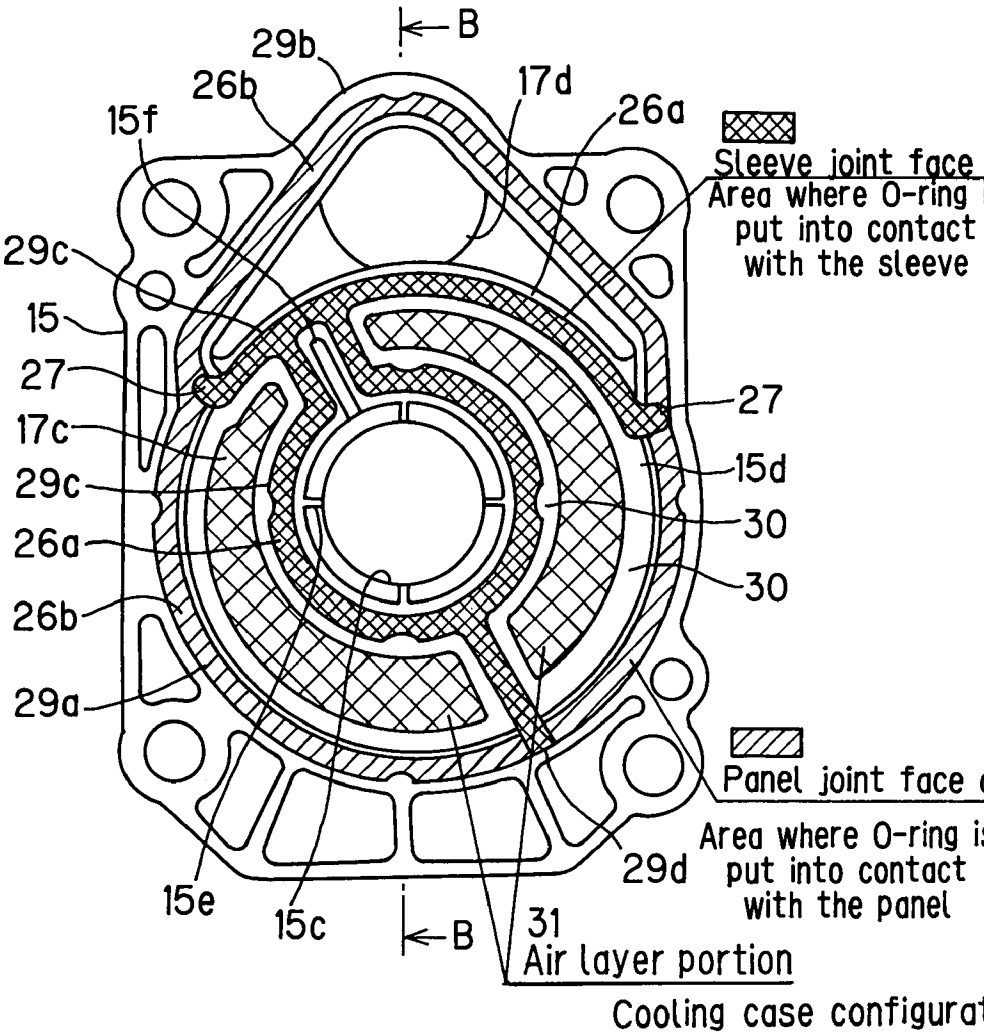
FIG. 5A is a bottom view for illustrating the configuration of a pump case of the cooling water pump device.

The pump case 15 has an approximate bowl-shape formed of large-diametric cylinder 15*a* with bottom opening 15*d* as stated above, and is constructed such that the pump case 15 accommodates impeller 16 with sleeve 25 interposed there around and the bottom opening 15*d* is enclosed with under-panel 19, forming the pump chamber 17*c*. As shown in FIG. 4 and FIGS. 5A and 5B, pump case 15 has driveshaft 10 vertically penetrated therethrough. The top part of small-diametric cylinder 15*b* located on the upper side is folded closer to the outer peripheral surface of driveshaft 10 so as to prevent water leakage from pump chamber 17*c* as strongly as possible. Further, a multiple number of reinforcing ribs 15*e* (provided at four places, equi-angularly apart along the circumference, in the embodiment) that project close to driveshaft 10 are formed parallel to the driveshaft 10 axis, from the top end of small-diametric cylinder 15*b* to the driveshaft insert hole 15*c*.

The sleeve 25 consists of a bottom 25*a* and a side wall portion 25*b* and has an approximately cylindrical cap-like configuration with its bottom 25*a* positioned up, and is fitted to the interior of large-diametric cylinder 15*a* of pump case 15, in a close contact manner. The interior of sleeve 25 substantially constitutes the pump chamber 17*c* with which impeller 16 comes into frictional contact. Formed at a place in the upper part of sleeve 25, i.e. , bottom 25*a*, corresponding to the driveshaft insert hole 15*c* is an insert hole 25*c* similar to insert hole 15*c* for allowing insertion of driveshaft 10. In the sleeve side wall portion 25*b*, a cutout 25*d* that allows communication between pump chamber 17*c* and outlet 17*d* is formed at a place corresponding to the ejection port 17*f*, i.e. , the cutout window located in the lower part of guide wall portion 17*a* of pump case 15.

Here, sleeve 25 is made of metal, preferably stainless steel, and may be formed by diverse methods such as press-forming, casting and forging, and also may be formed with uniform thickness or varying thickness.

The lower side of seal is established by the lower annular seal element 26*b* interposed between the periphery of the bottom opening 15*d* of pump case 15 and under-panel 19. In this embodiment, this seal element is provided in an approximately circular, partly angled, irregular shape, as shown in FIGS. 5A and 5B and FIGS. 6A and 6B, surrounding the periphery of pump chamber 17*c* and the periphery of outlet 17*d*.

Further, the upper annular seal element 26*a* is formed of an approximately circular shaped part arranged around the driveshaft insert hole 15*c* located at an upper position of the inner peripheral side of resin pump case 15 and a rectangular portion having two parallel sides enclosing an air discharge opening (air discharge hole) 15*f* extended from the insert hole 15*c* that is connected to small-diametric cylinder 15*b*. Therefore, the upper annular seal element 26*a* has an approximate circular, partly irregular form having projections for covering air discharge opening 15*f*.

Provided between the lower annular seal element 26*b* and the upper annular seal element 26*a* are joint seal elements 27, which are formed at positions adjoining the guide wall portion 17*a* where ejection port 17*f* of pump chamber 17*c* is cut out and at the wall opposite to the guide wall portion 17*a*.

Here, the annular seal elements 26*a* and 26*b* and joint seal elements 27 have circular cross-sections or so-called O-ring configurations. However, they can be formed to have various cross-sections to obtain appropriate sealing performance: they may be formed to have partly rectangular cross-sections at necessary positions, for example.

On the other hand, in order to fit annular seal elements 26*a* and 26*b* and joint seal elements 27, grooves 29*a* to 29*d* are formed at necessary sites in the inner peripheral surface of the resin pump case 15. Specifically, a groove 29*a* for receiving the lower annular seal element 26*b* is undercut formed in the interior side (other than guide wall portion 17*a*) surrounding pump chamber 17*c* at the bottom opening 15*d* while a groove 29*b* for receiving the lower annular seal element 26*b* is recessed so as to surround outlet 17*d* (other than guide wall portion 17*a*) continuously from the groove 29*a*.

Further, a groove 29*c* for receiving the upper annular seal element 26*a* is formed in a recessed configuration, around the driveshaft insert hole 15*c* and towards the upper proximal part of guide wall portion 17*a* along air discharge opening 15*f*.

Further, in the interior wall surface of pump case 15, grooves 29*d* for receiving joint seal elements 27 that connect the upper annular seal element 26*a* and lower annular seal element 26*b* are formed vertically in the inserted direction of driveshaft 10 at both sides of guide wall portion 17*a* and at a position on its opposite side.

As shown in FIGS. 5A and 5B, the interior surface of pump case 15, specifically, the top peripheral part (the peripheral area that faces the bottom 25*a* of sleeve 25) of large-diametric cylinder 15*a*, is hollowed out leaving the contour of the groove 29*c* for receiving the upper annular seal element 26*a*, forming ridge-like ribs 30 that project downwards (downwards in the axis direction of driveshaft 10). The lower endface of the thus formed ribs 30, or the lowermost part with respect to the axial direction of driveshaft 10, abuts the bottom 25*a* of sleeve 25, creating clearance between the interior surface of pump case 15 and metal sleeve 25, hence forming an air layer 31.

Thus, the spaces are created between ribs 30 and 30, so that air layer 31 can be formed between the peripheral area of the ceiling surface of pump case 15 and the bottom 25*a* of sleeve 25 when sleeve 25 is fitted into pump case 15.

As described above, the annular seal elements 26*a* and 26*b* establish watertightness between the inner peripheral surface of resin pump case 15 and metal sleeve 25, so that it is possible to prevent seawater from infiltrating into the interface between pump case 15 and sleeve 25 by virtue of the water-protective function of the annular seal elements 26*a* and 26*b* even when the outboard motor is used in the sea.

Further, since lower annular seal element 26*b* is interposed between the rim of bottom opening 15*d* of resin pump case 15 and under-panel 19, it is possible to provide a bottom-open pump case configuration made up of pump case 15 and bottom opening 15*d*, which facilitates easy assembly of sleeve 25 and impeller 16, and it is also possible to prevent cooling water in the pump chamber 17*c* from infiltrating into the interface between pump case 15 and sleeve 25, by keeping watertightness (water preventive function) between the rim of bottom opening 15*d* and under-panel 19 that closes the bottom opening 15*d*, with the provision of reliable lower annular seal element 26*b*.

Of the seal elements, joint seal elements 27 are formed at such positions as to enclose the ejection port of pump chamber 17*c*, so it possible to prevent water such as seawater from infiltrating into the interface between pump case 15 and sleeve 25 through the surrounding of ejection port 17*f* of pump chamber 17*c*, in a more reliable manner. Further, since grooves 29*a* to 29*d* for receiving seal elements 26 and 27 are also formed on the inner peripheral surface of the resin pump case 15, fitting of seal elements 26 and 27 into these grooves 29*a* to 29*d* for assembly of seal elements 26 and 27 into pump case 15 can be achieved in a simple and reliable manner.

Further, sealing is performed by continuous sealing structure 28 made of elastic resin, constituted of upper annular seal element 26*a*, lower annular seal element 26*b* and joint seal elements 27, watertightness against infiltration of water such as seawater into the interface between pump case 15 and sleeve 25 can be achieved in a more reliable manner by the integrated water protecting function of the joined elements. Moreover, handling at manufacturing and assembly can be simplified compared to that when seal elements 26 and 27 are provided piece by piece. Further, the seal can be formed of resin material of a uniform composition and the strength at the joints can be enhanced in terms of design.

Since ribs 30 are formed on the interior surface of pump case 15, which produces air layer 31 between the interior surface of pump case 15 and sleeve 25, frictional heat arising when impeller 16 frictionally rotates inside sleeve 25 can be prevented from transferring to pump case 15 by insulation and reduction of heat conduction owing to presence of air layer 31. As a result it is possible to reliably prevent resin pump case 15 from being heated by the frictional heat.

Accordingly, it is possible to prevent resin pump case 15 from melting.

The present invention is not limited to the above embodiment, but various modifications can be added.

Figure 6A:
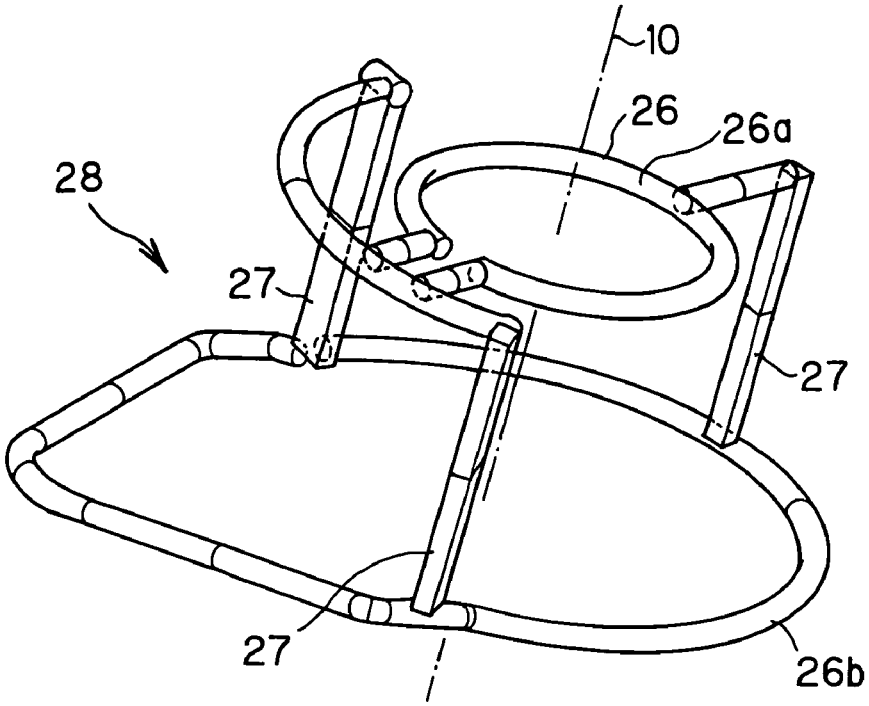
FIGS. 6A and 6B are constructional illustrations of an integrally formed sealing structure to be fitted to the cooling water pump device.
Figure 6B:
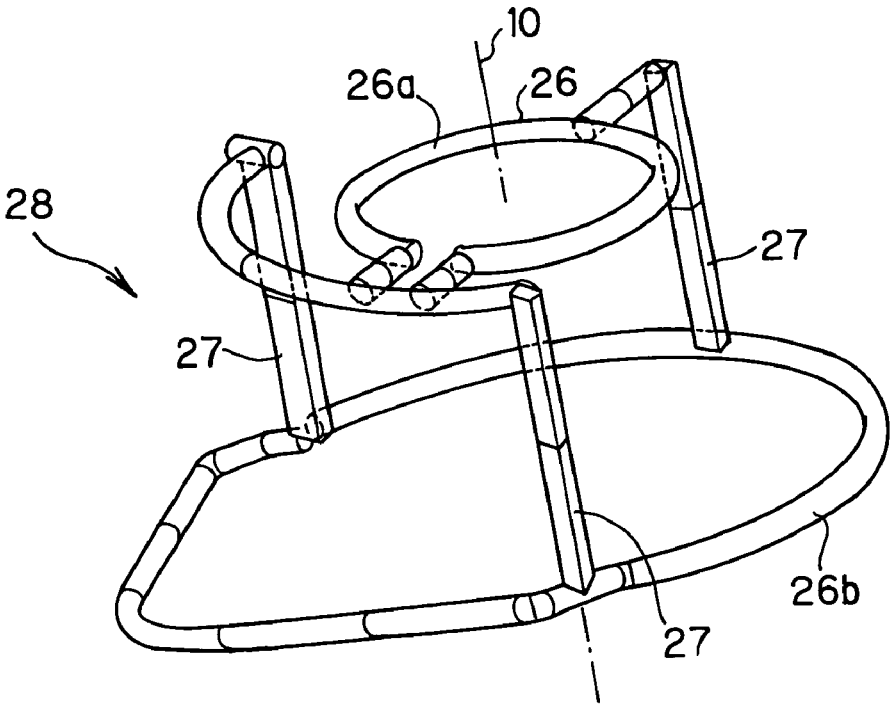
Figure 7:
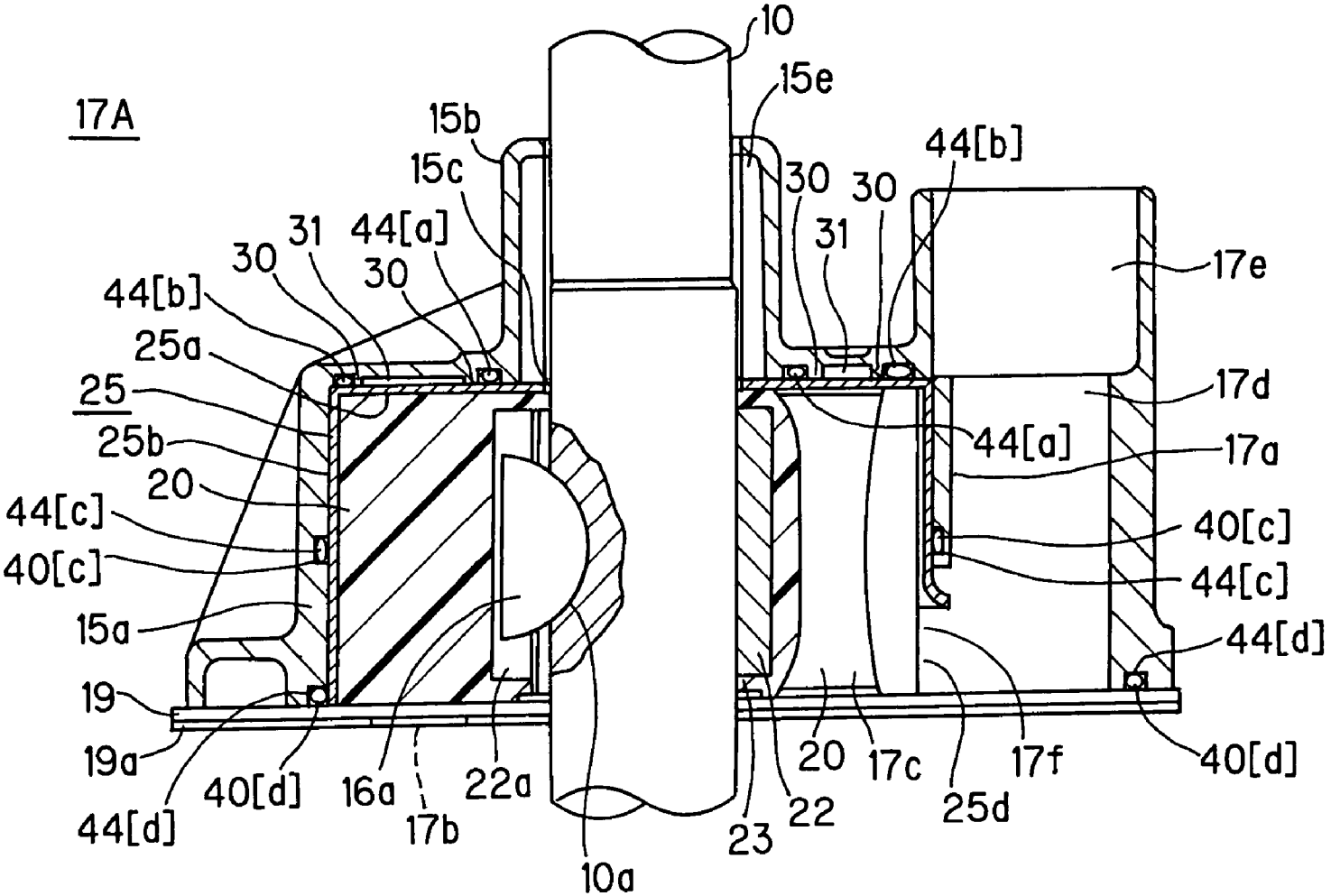
FIG. 7 is a vertical sectional view for illustrating the configuration of a cooling water pump device according to another embodiment of the present invention.

FIG. 7 is a vertical sectional view of a cooling water pump device 17A of an outboard motor according to another embodiment of the present invention. FIG. 7 corresponds to FIG. 4 of the above embodiment. This second embodiment has almost the same configuration except in that the configurations and arrangement of seal elements 40 and 42 are different from those of the embodiment shown in FIG. 1 to FIGS. 6A and 6B, so the same components are allotted with the same reference numerals.

Cooling water pump device 17A of an outboard motor of the second embodiment, similarly to the embodiment shown in FIGS. 1 to 3, is provided for an outboard motor including an engine 6, a hollow driveshaft housing 8 under the engine; and a driveshaft 10 arranged vertically in the driveshaft housing 8 for transmitting the drive force of a crankshaft 6*a* of engine 6 to a screw 9. In this outboard motor, the cooling water pump device functions in the following manner. That is, a pump case 15 made of resin is arranged at a position partway through the length of the driveshaft 10 in the drive housing 8; an impeller 16 made of elastic material is accommodated eccentrically in the pump case with a metal sleeve 25 interposed therebetween; and the impeller 16 is rotated by driving of the driveshaft 10, whereby cooling water is drawn in from an inlet 17*b* at the bottom of pump case 15 and pumped up toward the engine 6 located above.

In this pump device 17A according to the second embodiment, annular seal elements 40[*a*] to 40[*d*] that surround the driveshaft 10 for keeping watertightness at the interface between the inner peripheral surface of the resin pump case 15 and metal sleeve 25 are disposed between the inner peripheral surface of the resin pump case 15 and metal sleeve 25, at multiple sites vertically apart with respect to the axial direction of driveshaft 10 while joint seal elements 42[*a*] to 42[*o*] that join annular seal elements 40[*a*] to 40[*d*] to each other are provided.

Pump case 15 has an approximate bowl-shape with a bottom opening 15*d* (for example, a bowl placed upside down) and is constructed such that the pump case 15 accommodates impeller 16 and the bottom opening 15*d* is enclosed with an under-panel 19, forming a pump chamber 17*c*.

For the cooling water pump device 17A of the second embodiment, there are variational examples 1 to 7 as shown in FIGS. 8A and 8B to FIGS. 14A and 14B, where different types of sealing structures are configured by combinations of annular seal elements 40[*a*] to 40[*d*] and joint seal elements 42[*a*] to 42[*o*].

FIGS. 8A and 8B to FIGS. 14A and 14B show the arrangements of annular seal elements 40[*a*] to 40[*d*] and joint seal elements 42[*a*] to 42[*d*] of sealing structures of examples 1 to 7, indicated with reference numerals.

In FIGS. 8A and 8B to FIGS. 14A and 14B, diagrams A are schematic expansion plans showing respective sealing structures made up of seal elements in examples 1 to 7, by pressing each sealing structure from above. In FIGS. 8A and 8B to FIGS. 14A and 14B, diagrams B are schematic perspective views showing each sealing structure made up of seal elements.

Any of annular seal elements 40[*a*] to 40[*d*] is composed of an annular so-called O-ring that surrounds driveshaft 10 uninterrupted.

As shown in FIG. 7, these annular seal elements 40[*a*] and 40[*b*] are fitted in grooves 44[*a*] and grooves 44[*b*], respectively, both of which are in the ceiling surface of the interior surface of large-diametric cylinder 15*a* of pump case 15, the former being formed at a position closest to driveshaft 10 and the latter being formed at a position away from the groove 44[*a*]. Annular seal element 40[*c*] and 40[*d*] are fitted in grooves 44[*c*] and grooves 44[*d*], respectively, the former being formed at a position higher than the upper end of ejection port 17*f* on the side wall of large-diametric cylinder 15*a*, the latter being formed on the undersurface of large-diametric cylinder 15*a*.

These grooves 44[*a*] to 44[*d*] are to be formed in conformity with the arrangement of the seal elements, and can be formed as appropriate in accordance with the disposition of the annular seal elements.

Joint seal elements 42[*e*] to 42[*g*] extend substantially in the radial direction or axial direction of driveshaft 10, and are formed, as will be described hereinbelow, at two places (42[*e*], 42[*f*]) adjoining ejection port 17*f* and at a place (42[*g*]) on the side opposite to ejection port 17*f*. With this arrangement, the joint seal elements provide watertight function, i.e. , the function of preventing water such as seawater from infiltrating into the interface between pump case 15 and sleeve 25 and the function of joining the annular seal elements and forming an integrated sealing structure. In other examples, joint seal elements, designated at 42[*h*] to 42[*o*], which extend along annular seal elements 40[*a*] to 40[*d*] are also provided.

These joint seal elements 42[*e*] to 42[*g*] have an O-shaped section as the aforementioned annular seal elements do, and the positions of their attachment are formed with grooves (not shown) which extend in the radial direction or axial direction of driveshaft 10, in order to prevent their displacement.

Figure 8A:
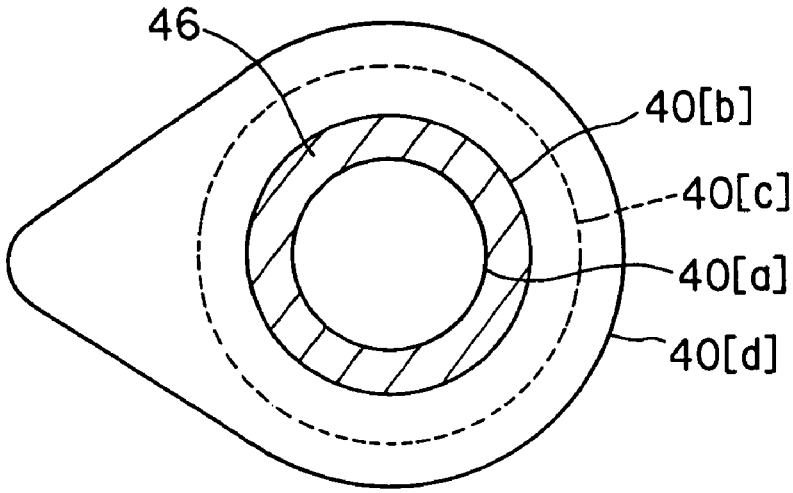
FIGS. 8A and 8B are illustrative views of example 1 of a sealing structure constructed by combination of annular seal elements, provided for a cooling water pump device according to the embodiment shown in FIG. 7, FIG. 8A a top view, FIG. 8B a perspective illustration.
Figure 8B:
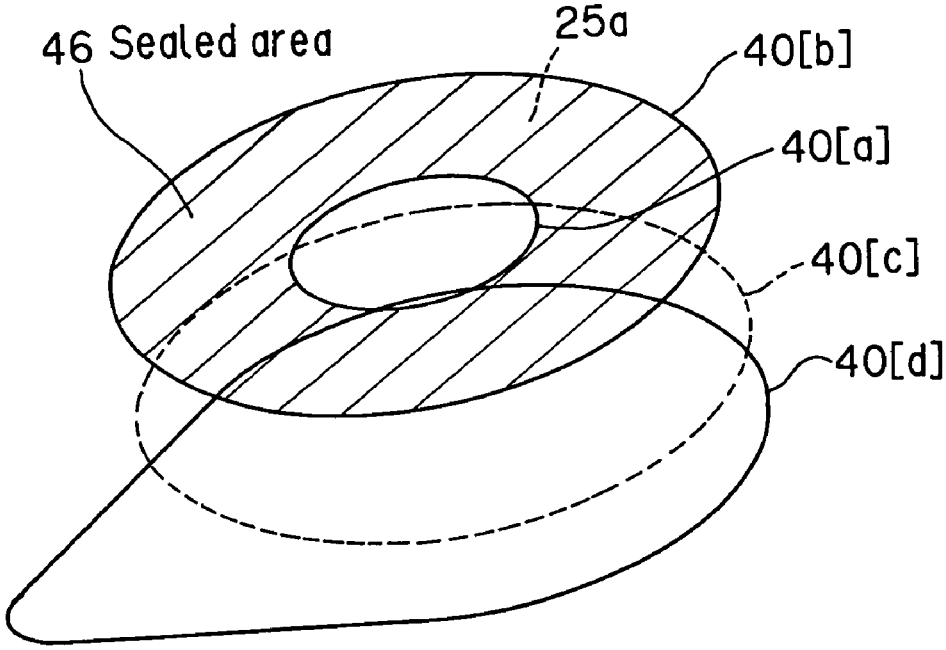

As shown in FIGS. 8A and 8B, the annular seal element indicated at 40[*a*] is arranged at a position, inside the large-diametric cylinder 15*a* of pump case 15, opposing the bottom 25*a* of sleeve 25, adjacent to and surrounding driveshaft 10, or adjoining and surrounding insert hole 15*c*, and closest, among the annular seal elements, to driveshaft 10.

The annular seal element indicated at 40[*b*] is arranged at a position, inside the large-diametric cylinder 15*a* of pump case 15, opposing the bottom 25*a* of sleeve 25 at the vicinity of side wall portion 25*b*, in other words, at a position surrounding insert hole 15*c* through which driveshaft 10 is inserted and away from the insert hole, or near the circumference of the sleeve.

Further, the annular seal element indicated at 40[*c*] is arranged surrounding driveshaft 10 at a position on the interior side of the side wall portion of large-diametric cylinder 15*a*, opposing the side wall portion 25*b* of sleeve 25, and formed annularly passing along the upper edge of the cutout 25*d* of sleeve 25 and above ejection port 17*f*. This annular seal element 40[*c*] in cooperation with an annular seal element designated at 40[*d*] encloses the upper end of ejection port 17*f* of pump chamber 17*c*.

The annular seal element designated at 40[*d*] is interposed between the rim of bottom opening 15*d* of pump case 15 and under-panel 19. This seal element roughly has a circular and partly angled, irregular shape, in correspondence with the bottom opening 15*d* of pump case 15. In this respect, this seal element has the same configuration as that of lower annular seal element 26*b* described in the foregoing embodiment.

First, sealing structures of examples 1 and 2 will be described with reference to FIGS. 8A and 8B and FIGS. 9A and 9B.

The sealing structures in examples 1 and 2 are made up of the aforementioned annular seal elements only, which are arranged at the upper end of ejection port 17*f* of the pump chamber and at places surrounding driveshaft insert hole 15*c* of the upper part of pump case 15, so as to provide watertightness between pump case 15 and sleeve 25.

EXAMPLE 1

The sealing structure of example 1 is given in combination of annular seal elements denoted by 40[*a*], 40[*b*] and 40[*d*], as shown in FIGS. 8A and 8B. Specifically, this sealing structure is composed of an annular seal element 40[*a*] located close to insert hole 15*c* of driveshaft 10 in large-diametric cylinder 15*a*, an annular seal element 40 [*b*] located at a place away from the above element and close to the periphery of large-diametric cylinder 15*a* and an annular seal element 40[*d*] interposed between the rim of bottom opening 15*d* of pump case 15 and under-panel 19.

In FIGS. 8A and 8B, the sealed area (watertight area) from the annular seal elements is indicated by hatching 46. In FIGS. 8A and 8B, the broken line denotes the position of annular seal element 40[*c*].

With the above sealing structure of example 1, sealed area 46 is set up to extend between ceiling area of large-diametric cylinder 15*a* and the bottom 25*a* of sleeve 25, as shown in FIGS. 8A and 8B. In the conventional pump case 15, this ceiling area of large-diametric cylinder 15*a* is most likely to cause drawbacks when the engine is operated in the dry without cooling water. Therefore, sealing only this area works well to fix the drawback. Water such as seawater having infiltrated between pump case 15 and sleeve 25 drains off and is unlikely to stagnate across the side wall portion of pump case 15 and sleeve 25, no cracks of sleeve 25 due to salt buildup will occur.

EXAMPLE 2

Figure 9A:
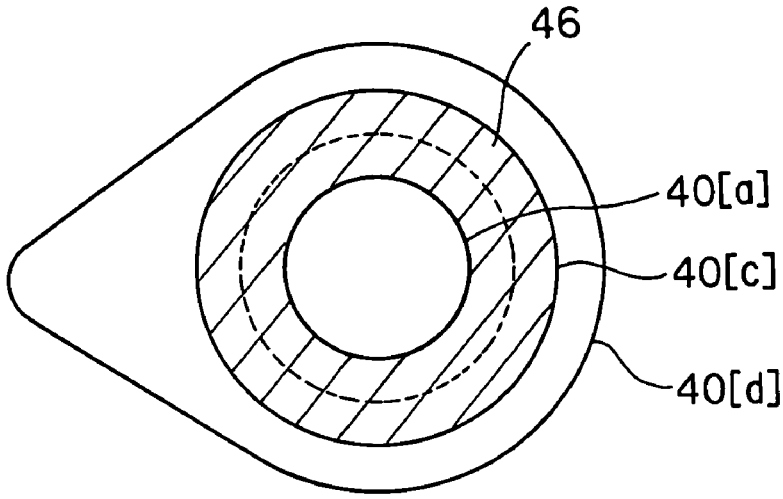
FIGS. 9A and 9B are illustrative views of example 2 of a sealing structure constructed by combination of annular seal elements, FIG. 9A a top view, FIG. 9B a perspective illustration.
Figure 9B:
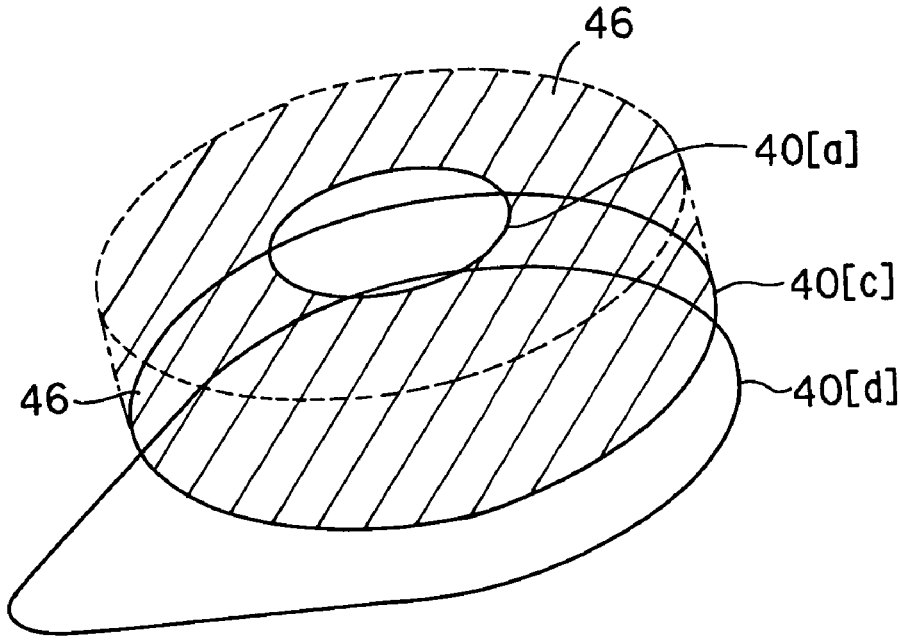

The sealing structure of example 2 is given in combination of annular seal elements denoted by 40[*a*], 40[*c*] and 40[*d*], as shown in FIGS. 9A and 9B. Specifically, this sealing structure is composed of an annular seal element 40[*a*] located close to insert hole 15*c* of driveshaft 10 in large-diametric cylinder 15*a*, an annular seal element 40 [*c*] arranged opposing the side wall portion 25*b* of sleeve 25 and annularly passing along the upper edge of the cutout 25*d* of sleeve 25 and near and above ejection port 17*f*, and an annular seal element 40[*d*] interposed between the rim of bottom opening 15*d* of pump case 15 and under-panel 19.

In the above sealing structure of example 2, sealed area 46 shown in FIGS. 9A and 9B is made to extend up to the side wall portion of large-diametric cylinder 15*a*, though only the ceiling portion of large-diametric cylinder 15*a* can be sealed in the sealing structure of example 1. Thus the sealed area is enlarged.

Next, sealing structures of examples 3 to 7 will be described with reference to FIGS. 10A and 10B to FIGS. 14A and 14B.

As shown in FIGS. 10A and 10B to FIGS. 14A and 14B, the sealing structures of examples 3 to 7 employ joint seal elements 42[*e*] to 42[*m*] which extend in the radial direction or axial direction of driveshaft 10 to connect any one of the annular seal elements 40[*a*] to 40[*d*] to another or a plurality of joint seal elements 42[*n*], 42[*o*] along annular seal elements 40[*a*] to 40[*d*], so as to construct unified parts formed of the annular seal elements made of elastic resin material for providing watertightness at the interface between the inner peripheral surface of the resin pump case 15 and metal sleeve 25.

EXAMPLE 3

Figure 10A:
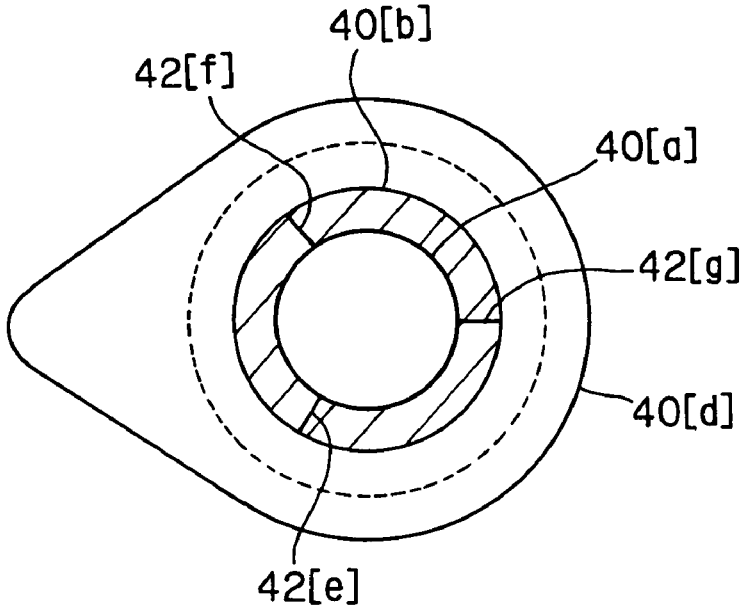
FIGS. 10A and 10B are illustrative views of example 3 of a sealing structure constructed by combination of annular seal elements and joint seal elements, FIG. 10A a top view, FIG. 10B a perspective illustration.
Figure 10B:
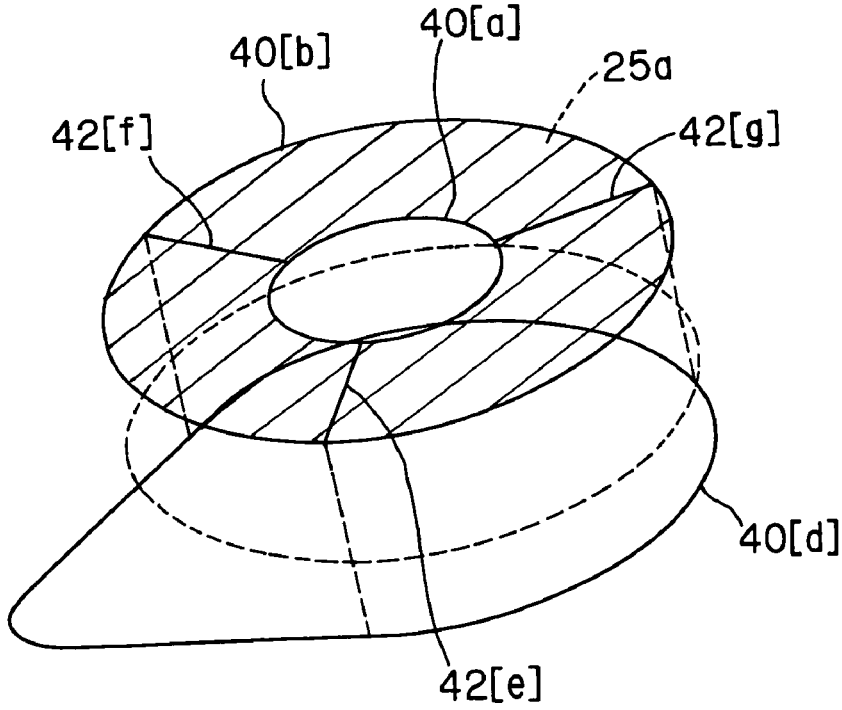

The sealing structure of example 3 is configured, as shown in FIGS. 10A and 10B, so that the aforementioned annular seal elements are arranged at a place (40[*a*]) adjacent to insert hole 15*c* and at another place (40[*b*]) away from the former, both surrounding driveshaft insert hole 15*c* at the upper position of the pump case 15, and three joint seal elements (42[*e*] to 42[*g*]) extending in the radial direction of driveshaft 10 are provided to join the annular seal elements one to another. Further, an annular seal element 40[*d*] is interposed at the position between the rim of bottom opening 15*d* of pump case 15 and under-panel 19.

This sealing structure is given in combination of an annular seal element 40[*a*] located close to insert hole 15*c* of driveshaft 10 in large-diametric cylinder 15*a*, an annular seal element 40[*b*] located at a place more distant from insert hole 15*c* and close to the periphery of large-diametric cylinder 15*a*, joint seal elements 42[*e*] to 42[*g*] arranged radially therebetween for joining these annular seal elements 40[*a*] and 40[*b*], and an annular seal element 40[*d*] interposed between the rim of bottom opening 15*d* of pump case 15 and under-panel 19.

With this sealing structure of example 3, as shown in FIGS. 10A and 10B, a sealed area 46 extending between ceiling area of large-diametric cylinder 15*a* and the bottom 25*a* of sleeve 25 are created in the same manner as the sealed area of the sealing structure of example 1 shown in FIGS. 8A and 8B. In addition, since annular seal elements 40[*a*] and 40[*b*] are connected by joint seal elements 42[*e*] to 42[*g*], the annular seal elements 40[*a*] and 40[*b*] are unlikely to separate compared to the sealing structure of example 1, hence this configuration brings about higher watertightness and improvement in assembly.

EXAMPLE 4

Figure 11A:
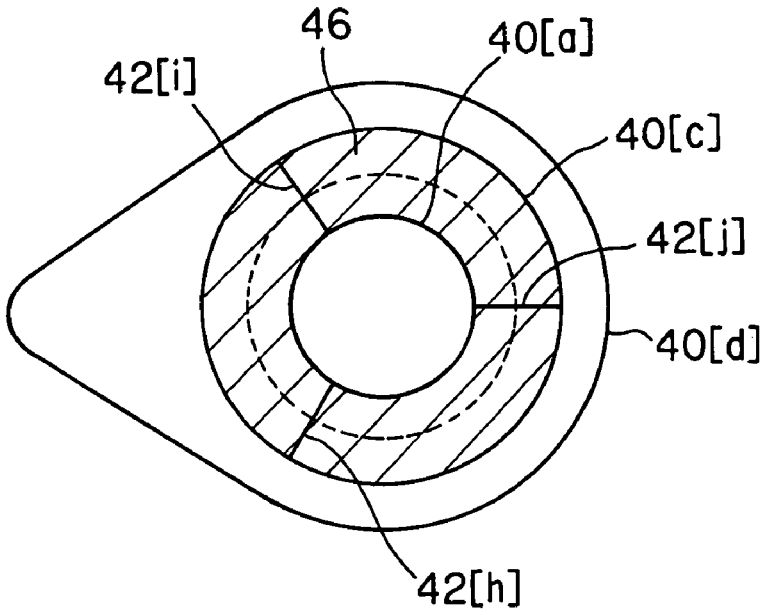
FIGS. 11A and 11B are illustrative views of example 4 of a sealing structure constructed by combination of annular seal elements and joint seal elements, FIG. 11A a top view, FIG. 11B a perspective illustration.
Figure 11B:
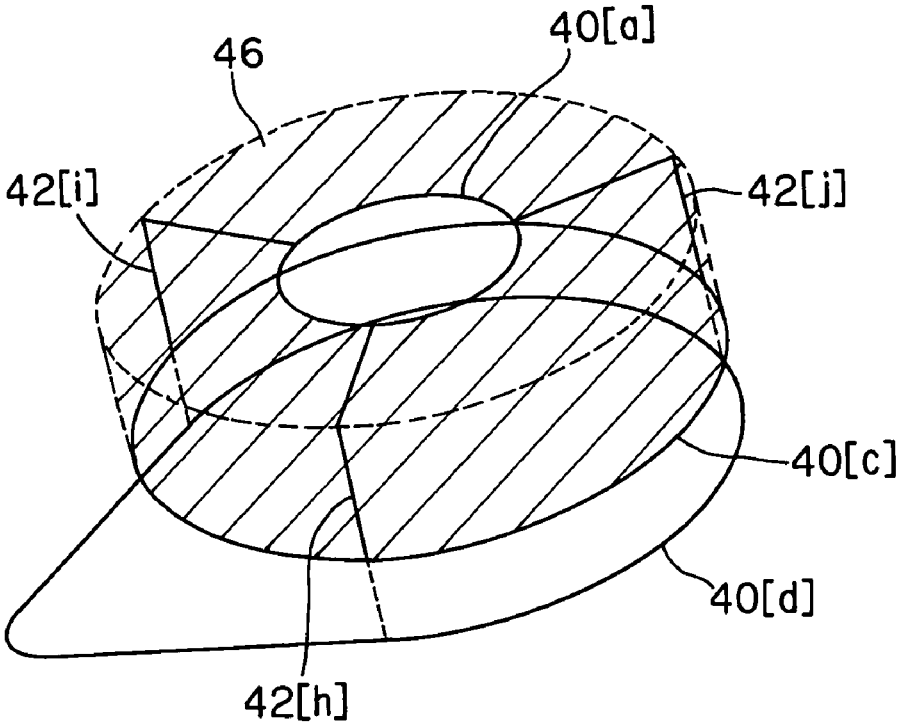

The sealing structure of example 4 is configured such that, as shown in FIGS. 11A and 11B, the annular seal elements are disposed at the upper end (40[*c*]) of ejection port 17*f* of the pump chamber 17*c* and at a place (40[*a*]) surrounding the driveshaft insert hole at the upper position of the pump case, and three joint seal elements (42[*h*] to 42[*j*]) that extend in the radial direction of driveshaft 10 and connect between the above annular seal elements are provided. Further, an annular seal element 40[*d*] is interposed at the position between the rim of bottom opening 15*d* of pump case 15 and under-panel 19.

Specifically, this sealing structure of example 4 is composed of annular seal element 40[*a*] located close to insert hole 15*c* of driveshaft 10 in large-diametric cylinder 15*a*, annular seal element 40[*c*] arranged opposing the side wall portion 25*b* of sleeve 25 and passing along the upper edge of the cutout 25*d* of sleeve 25 and near and above ejection port 17*f*, and joint seal elements 42[*h*] to 42[*j*] having an inverted L-shape or a hook-shape, viewed from a circumferential direction of driveshaft 10, arranged radially for joining these annular seal elements 40[*a*] and 40[*c*], and annular seal element 40[*d*] interposed between the rim of bottom opening 15*d* of pump case 15 and under-panel 19.

This sealing structure of example 4 is configured, as shown in FIGS. 11A and 11B, so that a sealed area 46 covers the ceiling area of large-diametric cylinder 15*a* and extends from it to cutout 25*d* of side wall portion 25*b* of sleeve 25 or the upper end of ejection hole 17*f*. In addition, since annular seal elements 40[*a*] and 40[*c*] are connected by joint seal elements 42[*h*] to 42[*j*], the annular seal elements 40[*a*] and 40[*c*] are unlikely to separate compared to the sealing structure of example 2, hence this configuration brings about higher watertightness and improvement in assembly.

EXAMPLE 5

Figure 12A:
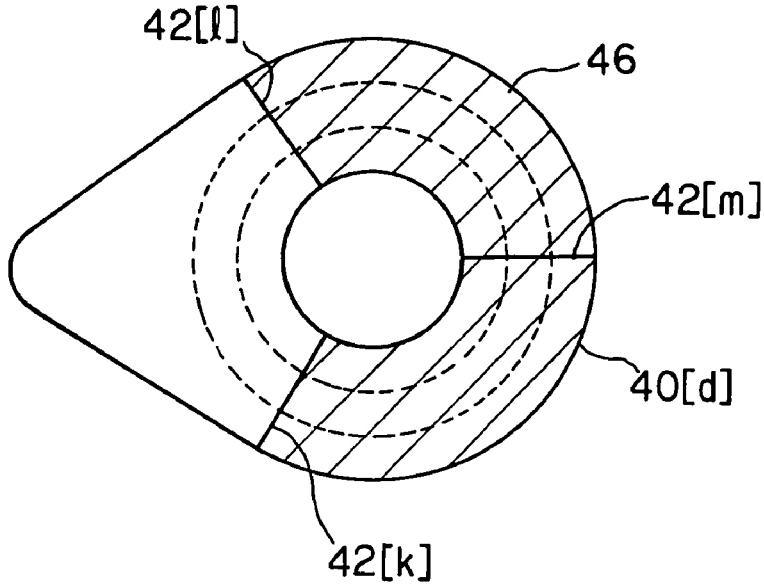
FIGS. 12A and 12B are illustrative views of example 5 of a sealing structure constructed by combination of annular seal elements and joint seal elements, FIG. 12A a top view, FIG. 12B a perspective illustration.
Figure 12B:
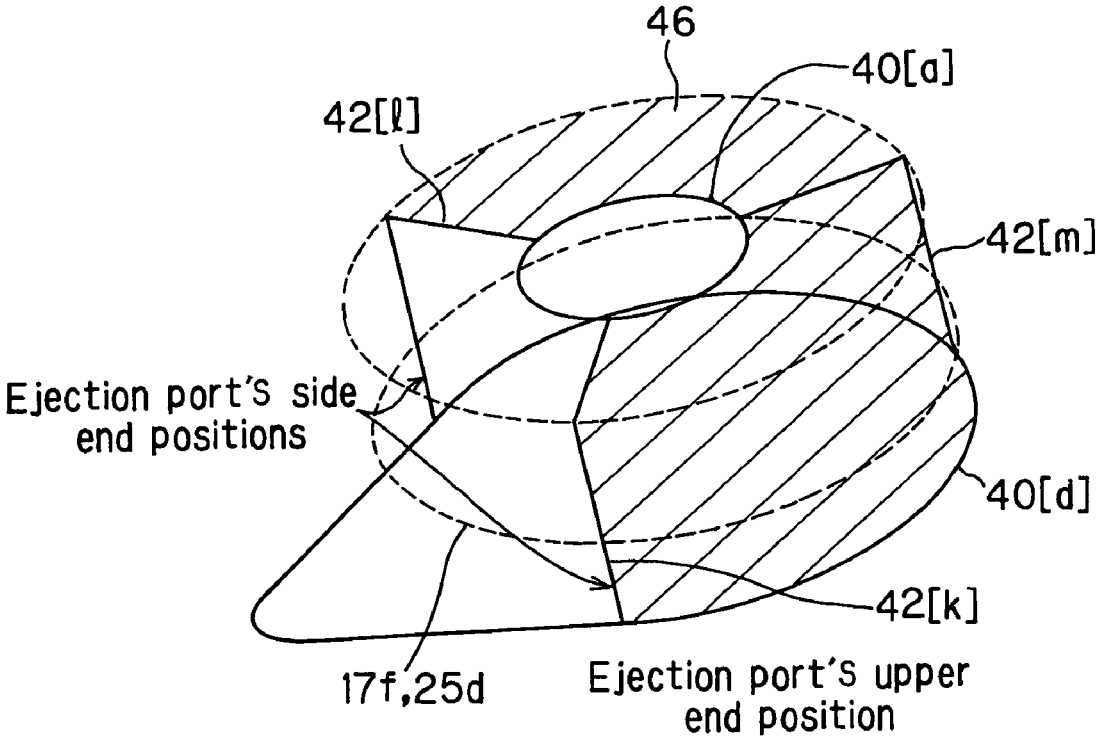

The sealing structure of example 5 is configured such that, as shown in FIGS. 12A and 12B, an annular seal element is disposed at a place (40[*a*]) surrounding the driveshaft insert hole 15*c* at the upper position of pump case 15, and an annular seal element is interposed at the position (40[*d*]) between the rim of bottom opening 15*d* of pump case 15 and under-panel 19. In addition, three joint seal elements (42[*k*] to 42[*m*]) that extend in the radial direction of driveshaft 10 and then in the axial direction are provided to connect between the above annular seal elements.

Specifically, this sealing structure of example 5 is composed of annular seal element 40[*a*] located close to insert hole 15*c* of driveshaft 10 in large-diametric cylinder 15*a*, annular seal element 40[*d*] interposed between the rim of bottom opening 15*d* of pump case 15 and under-panel 19, and joint seal elements 42[*k*] to 42[*m*] having an inverted L-shape or a hook-shape, viewed from a position perpendicular to the axis, arranged radially from the axis of driveshaft 10 for joining these annular seal elements 40[*a*] and 40[*d*].

With this sealing structure of example 5, as shown in FIGS. 12A and 12B, a sealed area 46 covers the ceiling area of large-diametric cylinder 15*a* and seals the surrounding of cutout 25*d* of the side wall portion 25*b* of sleeve 25 or the surrounding of the ejection port. That is, the ceiling area and two thirds of the side wall portion can be sealed. In addition, since annular seal elements 40[*a*] and 40[*d*] are connected by joint seal elements 42[*k*] to 42[*m*], improvement in assembly can be obtained.

EXAMPLE 6

Figure 13A:
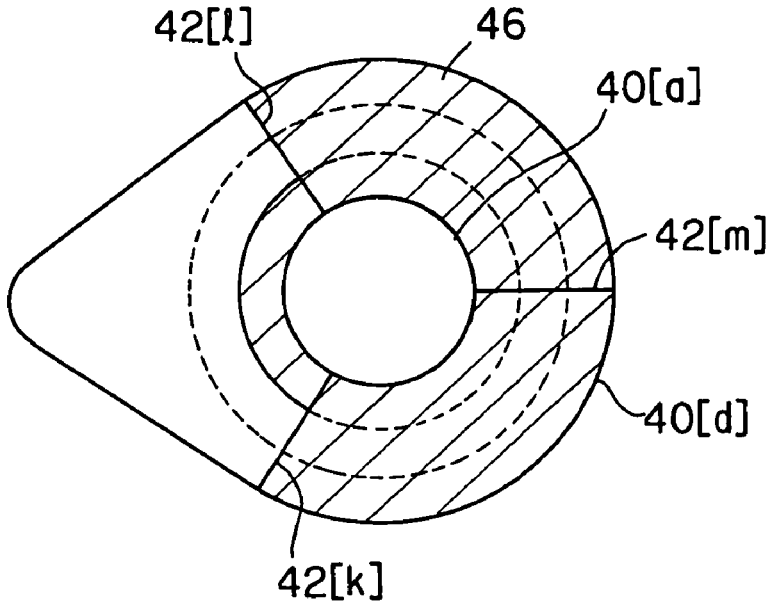
FIGS. 13A and 13B are illustrative views of example 6 of a sealing structure constructed by combination of annular seal elements and joint seal elements, FIG. 13A a top view, FIG. 13B a perspective illustration.
Figure 13B:
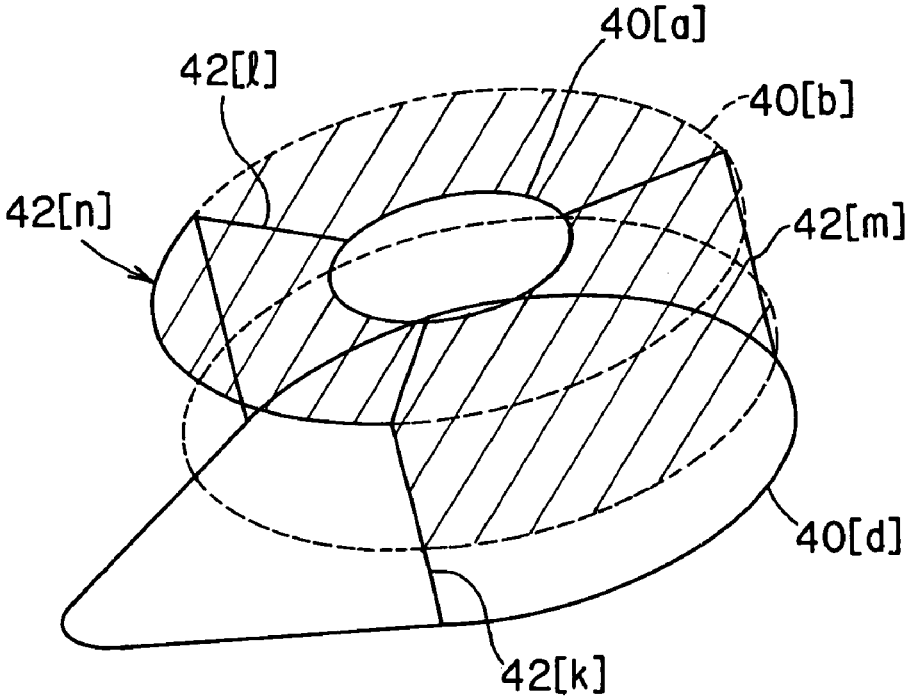

The sealing structure of example 6 is made up of, as shown in FIGS. 13A and 13B, the sealing structure of example 5 (annular sealing elements 40[*a*], 40[*d*] and joint sealing elements 42[*k*] to 42[*m*]) and a joint seal element 42[*n*] located at the ceiling of large-diametric cylinder 15*a* over ejection port 17*f* for connecting joint seal elements 42[*k*] and 42[*l*]. This joint seal element 42[*n*] lies at the same position as the aforementioned annular seal element 40[*b*] with respect to the axial direction of driveshaft 10, but formed only within the section over the ejection port 17*f*. Other configurations are the same as the sealing structure of example 5, so the same reference numerals are allotted to the same components.

This sealing structure of example 6 provides a more efficient water preventing function than that of example 5 to prevent water such as seawater from infiltrating into the interface between pump case 15 and sleeve 25 through ejection port 17*f*.

Here, the joint seal element 42[*n*] may be formed like the annular seal element 40[*b*], so as to be located between pump case 15 and sleeve 25 in a fully encircled configuration (the same configuration as annular seal element 40[*b*]). This further enhances watertightness.

This sealing structure of example 6 is similar to the seal structure of the embodiment shown in FIGS. 6A and 6B, differing in that annular seal element 26 in the first embodiment is formed with projected portions to detour air discharge hole 15*f*.

EXAMPLE 7

Figure 14A:
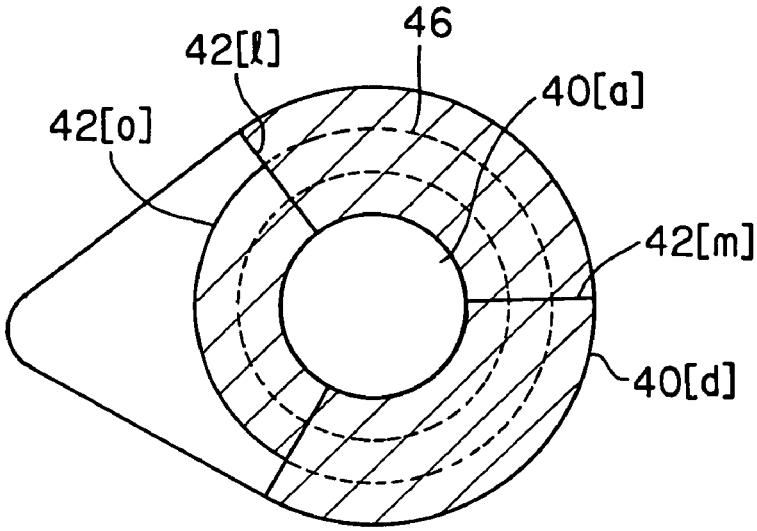
FIGS. 14A and 14B are illustrative views of example 7 of a sealing structure constructed by combination of annular seal elements and joint seal elements, FIG. 14A a top view, FIG. 14B a perspective illustration.
Figure 14B:
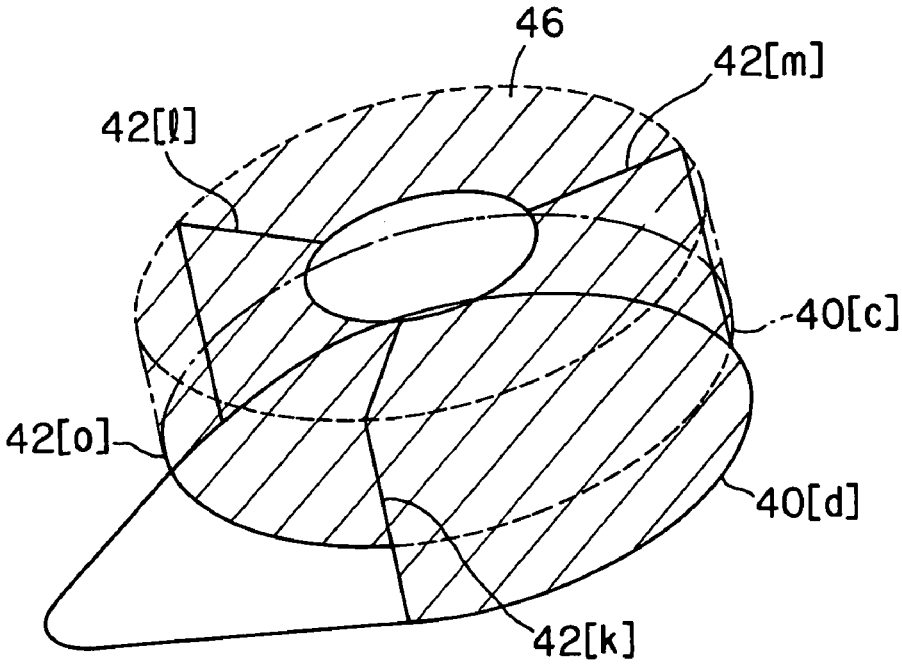
Figure 15:
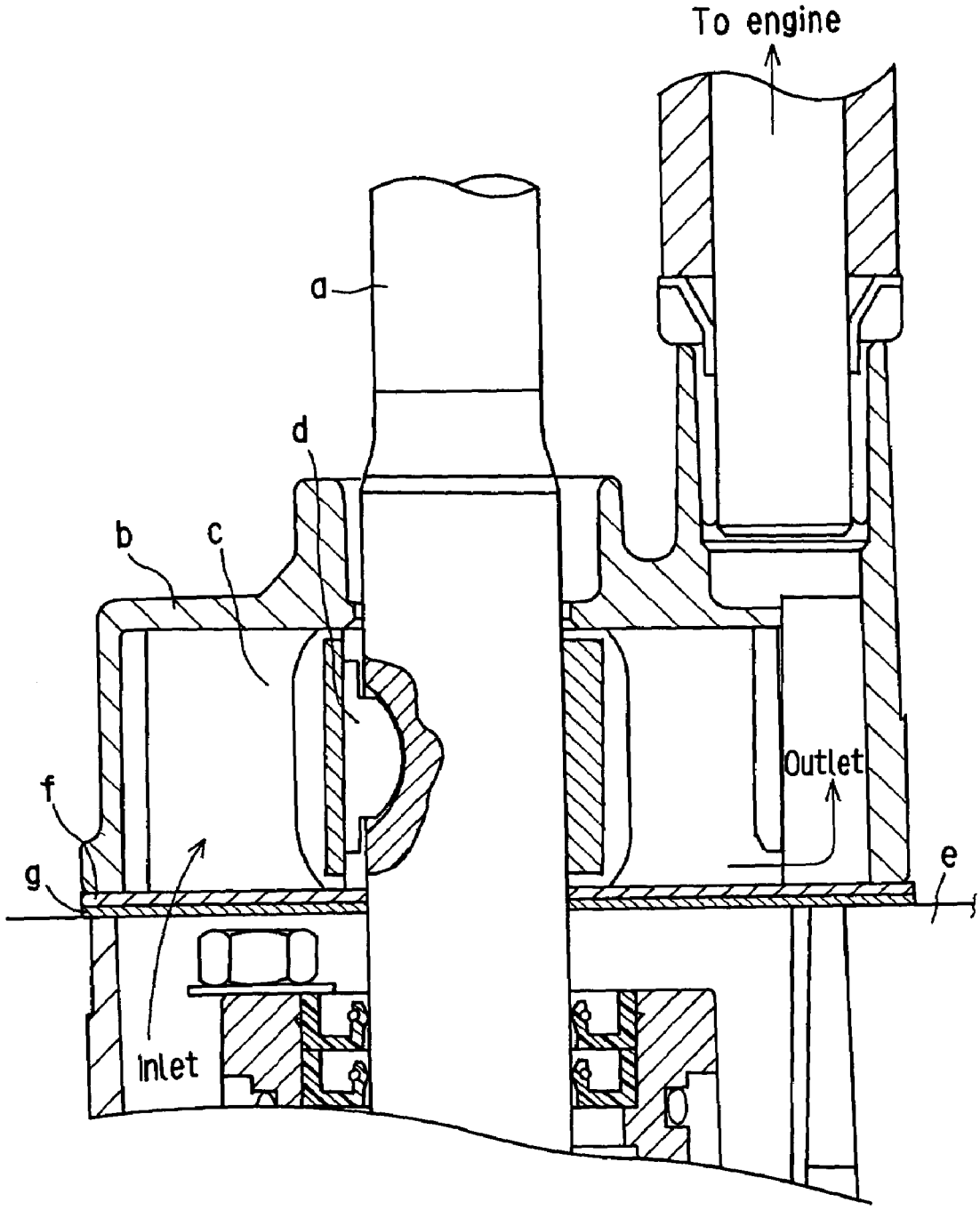
FIG.15 PRIOR ART
FIG. 15 is a structural illustration showing a conventional cooling water pump device with a pump case made of stainless steel.
Figure 16:
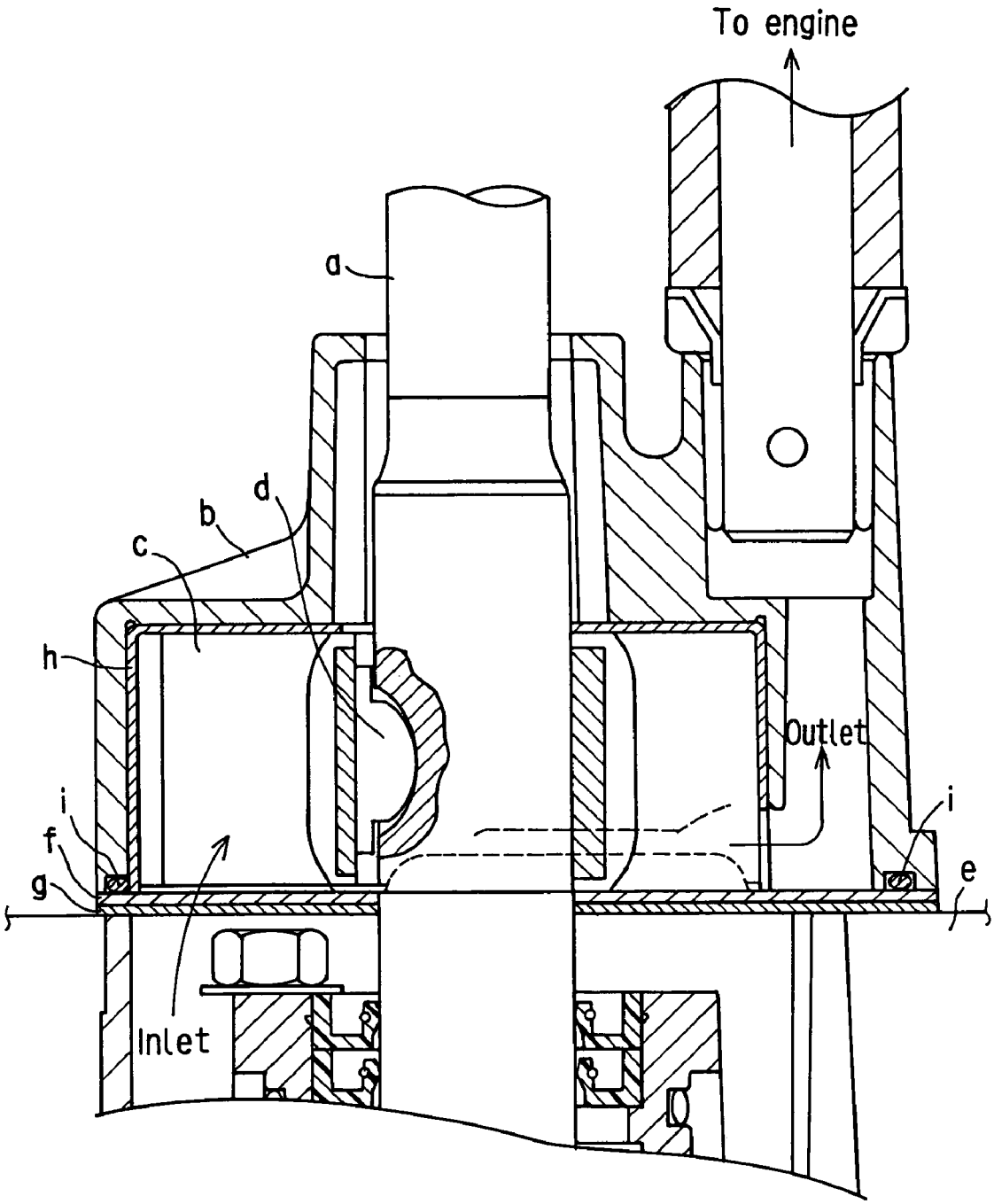
FIG.16 PRIOR ART
FIG. 16 is a structural illustration showing a conventional cooling water pump device with a pump case made of resin and a stainless sleeve fitted therein.

The sealing structure of example 7 is made up of, as shown in FIGS. 14A and 14B, the sealing structure of example 5 (annular sealing elements 40[*a*], 40[*d*] and joint sealing elements 42[*k*] to 42[*m*]) and a joint seal element 42[*o*] located adjacent to the upper portion of ejection port 17*f* for connecting joint seal elements 42[*k*] and 42[*l*]. This joint seal element 42[*o*] lies at the same position as the aforementioned annular seal element 40[*c*] with respect to the axial direction of driveshaft 10, but formed only within the section along the ejection port 17*f*. Other configurations are the same as the sealing structure of example 5, so the same reference numerals are allotted to the same components.

This sealing structure of example 7 provides a more efficient water preventing function than that of example 5 to prevent water such as seawater from infiltrating into the interface between pump case 15 and sleeve 25 through ejection port 17*f*. Here, the joint seal element 42[*o*] may be formed so as to be located between pump case 15 and sleeve 25 in a fully encircled configuration (the same configuration as annular seal element 40[*c*]). This further enhances watertightness.

According to the above embodiment, as seen in the sealing structures of the above examples 1 to 7 in the cooling water pump device 17A of an outboard motor, a plurality of annular seal elements 40[*a*] to 40[*d*] that surround the driveshaft 10 for creating watertightness at the interface between the inner peripheral surface of the resin pump case 15 and metal sleeve 25 are disposed vertically apart, one from another, with respect to the axial direction of driveshaft 10, between the inner peripheral surface of the resin pump case 15 and metal sleeve 25. Therefore it is possible to reliably prevent water such as seawater from infiltrating into the interface between pump case 15 and sleeve 25 by virtue of the water-preventive function of the annular seal elements even when the outboard motor is used in the sea.

Accordingly, it is possible to positively prevent the salt build up problem which would be caused when water, especially seawater infiltrates into and between the resin pump case and the metal sleeve as in the conventional cooling water pump device, and the drawback of cracks of the metal sleeve due to salt buildup.

Pump case 15 has an approximate bowl-shape having bottom opening which is enclosed by under-panel 19, forming pump chamber 17*c* that accommodates impeller 16 therein. As the sealing structure of example 2 shown in FIGS. 9A and 9B and that of example 4 shown in FIGS. 11A and 11B, at least the above-described annular seal elements 40 are disposed at the upper end of ejection port 17*f* of the pump chamber 17*c* and at a place surrounding driveshaft insert hole 15*c* at the upper position of the pump case 15, so that pump case 15 can be constructed so as to have a bottom opening which permits easy assembly of sleeve 25 and impeller 16. Also, provision of the annular seal elements at the upper end of ejection port 17*f* of the pump chamber 17*c* and at a place surrounding driveshaft insert hole 15*c* at the upper position of the pump case 15 produces sufficient watertightness performance. Further, since the portion that would cause inconveniences in a conventional pump case when a trial operation is carried out in the dry without cooling water is positioned in the top side area of the pump case and the place surrounding the driveshaft insert hole 15*c* at the upper position of pump case 15 and ejection port 17*f* of pump chamber 17*c* are sealed with the annular seal elements, it is possible to secure watertightness and solve the drawback during operation in the dry. As to the salt buildup inconvenience between pump case 15 and sleeve 25, water is unlikely to stagnate across the upright side wall portion of the sleeve 25 extending along the driveshaft, the provision of a seal at ejection port 17*f* and the place surrounding driveshaft insert hole 15*c* only also establishes effective watertightness.

As the sealing structures shown from examples 3 of FIGS. 10A and 10B through example 7 of FIGS. 14A and 14B, a plurality of joint seal elements 42 that extend in the axial direction or radial direction of driveshaft 10 to connect the annular seal elements 40 to each other are provided so as to produce a unified structure of the annular seal elements made up of elastic resin material to create watertightness between the inner peripheral surface of the resin pump case and the metal sleeve. Therefore, watertightness against infiltration of water such as seawater into the interface between the pump case and sleeve can be achieved in a more reliable manner by the integrated water protecting function of the joined elements. Moreover, handling at manufacturing and assembly is simple compared to that when the seal elements are provided piece by piece. Moreover, the seal can be formed of resin material of a uniform composition and the strength at the joints can be enhanced in terms of design.

As in example 7 shown in FIGS. 14A and 14B, the joint seal elements 42[*k*] to 42[*m*] are used to connect the lower annular seal element 40[*d*] interposed between the bottom opening rim of the pump case 15 and the under-panel 19, with the upper annular seal element 40[*a*] arranged at a place surrounding driveshaft insert hole 15*c* at the upper position of pump case 15 and the seal elements 42[*k*] and 42[*l*] are disposed at both sides of the ejection port of the pump chamber. Therefore, infiltration of water such as seawater into the interface between pump case 15 and sleeve 25 through the surrounding of the ejection port of the pump chamber can be more reliably prevented by these joint seal elements.

What is claimed is:

1. A cooling water pump device for pumping cooling water toward an engine of an outboard motor, the outboard motor including a hollow driveshaft housing under the engine and a driving shaft vertically mounted in the driveshaft housing for transmitting a drive force of a crankshaft of the engine to a screw, comprising:

a pump case made of resin disposed at a position partway, with respect to the axial direction of the driveshaft, inside the driveshaft housing and having an approximately bowl-like configuration having a bottom opening which is covered with an under-panel;

a sleeve made of metal fitted in the pump case;

an impeller made of elastic material mounted eccentrically in the pump case with the metal sleeve interposed therebetween, the impeller being rotated by rotational drive of the driveshaft to draw cooling water from the bottom of the pump case and pump the cooling water toward the engine located above;

a plurality of annular seal elements for keeping an interface between an inner peripheral surface of the resin pump case and the metal sleeve watertight, arranged between the inner peripheral surface of the resin pump case and the metal sleeve, surrounding the driveshaft, and disposed at plural positions vertically apart with respect to an axial direction of the driveshaft; and a pump chamber formed by the pump case for accommodating the impeller, and at least the annular seal elements are arranged at an upper end of an ejection port of the pump chamber and at a place surrounding a driveshaft insert hole at an upper position of the pump case.

2. The cooling water pump device for an outboard motor according to claim 1, wherein grooves for receiving seal elements are formed in the inner peripheral surface of the pump case.

3. A cooling water pump device for pumping cooling water toward an engine of an outboard motor, the outboard motor including a hollow driveshaft housing under the engine and a driving shaft vertically mounted in the driveshaft housing for transmitting a drive force of a crankshaft of the engine to a screw, comprising:

a pump case made of resin disposed at a position partway, with respect to the axial direction of the driveshaft, inside the driveshaft housing;

a sleeve made of metal fitted in the pump case;

an impeller made of elastic material mounted eccentrically in the pump case with the metal sleeve interposed therebetween, the impeller being rotated by rotational drive of the driveshaft to draw cooling water from the bottom of the pump case and pump the cooling water toward the engine located above;

a plurality of annular seal elements for keeping an interface between an inner peripheral surface of the resin pump case and the metal sleeve watertight, arranged between the inner peripheral surface of the resin pump case and the metal sleeve, surrounding the driveshaft, and disposed at plural positions vertically apart with respect to an axial direction of the driveshaft; and a plurality of joint seal elements that extend in the axial direction or radial direction of the driveshaft and connect the annular seal elements one to another for producing a unified structure comprising elastic resin material to keep the interface between the inner peripheral surface of the resin pump case and the metal sleeve watertight.

4. The cooling water pump device for an outboard motor according to claim 3, wherein the pump case has an approximately bowl-like configuration having a bottom opening which is covered with an under-panel forming a pump chamber that accommodates the impeller, and at least the annular seal elements are arranged at an upper end of an ejection port of the pump chamber and at a place surrounding a driveshaft insert hole at an upper position of the pump case.

5. The cooling water pump device for an outboard motor according to claim 3, wherein a lower annular seal element disposed between a bottom opening rim of the pump case and an under-panel and an upper annular seal element disposed at a place surrounding a driveshaft insert hole at an upper position of the pump case are connected by the joint seal elements, and at least the joint seal elements are arranged at both sides of an ejection port of the pump chamber.

6. The cooling water pump device or an outboard motor according to claim 3, wherein grooves for receiving seal elements are formed in the inner peripheral surface of the pump case.

7. A cooling water pump device for pumping cooling water toward an engine of an outboard motor that includes a hollow driveshaft housing under an engine and a driving shaft vertically mounted in the driveshaft housing for transmitting the drive force of the crankshaft of the engine to a screw, comprising:

a pump case made of resin disposed at a position partway, with respect to the axial direction of the driveshaft, inside the driveshaft housing;

a sleeve made of metal fitted in the pump case;

an impeller made of elastic material mounted eccentrically in the pump case with the metal sleeve interposed therebetween, the impeller being rotated by rotational drive of the driveshaft to draw cooling water from the bottom of the pump case and pump the cooling water toward the engine located above;

a plurality of annular seal elements for keeping an interface between an inner peripheral surface of the resin pump case and the metal sleeve watertight, arranged between the inner peripheral surface of the resin pump case and the metal sleeve, surrounding the driveshaft, and disposed at plural positions vertically apart with respect to the axial direction of the driveshaft; and ribs formed in an interior ace of the pump case so as to create an air layer between the pump interior surface and the metal sleeve.

8. The cooling water pump device for an outboard motor according to claim 7, wherein grooves for receiving seal elements are formed in the inner peripheral surface of the pump case.

* * * * *